US009287645B2

(12) United States Patent
Hashiguchi

(10) Patent No.: US 9,287,645 B2
(45) Date of Patent: Mar. 15, 2016

(54) CONNECTOR HAVING A FLEXIBLE FITTING PORTION TO CONNECT AND DISCONNECT TWO OBJECTS

(71) Applicant: JAPAN AVIATION ELECTRONICS INDUSTRY, LIMITED, Shibuyaku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/576,062

(22) Filed: Dec. 18, 2014

(65) Prior Publication Data

US 2015/0188256 A1 Jul. 2, 2015

(30) Foreign Application Priority Data

Dec. 27, 2013 (JP) ..... 2013-273014

(51) Int. Cl.

| | |
|---|---|
| ***H01R 13/629*** | (2006.01) |
| ***H01R 12/79*** | (2011.01) |
| ***H01R 12/62*** | (2011.01) |
| *H01R 4/48* | (2006.01) |

(52) U.S. Cl.

CPC ..... *H01R 12/79* (2013.01); *H01R 12/62* (2013.01); *H01R 13/62905* (2013.01); *H01R 4/48* (2013.01)

(58) Field of Classification Search

CPC ..... H01R 13/193; H01R 13/629; H01R 13/62905; H01R 13/62916; H01R 13/62922; H01R 23/6826; H01R 23/6833

USPC ..... 439/65–67, 74, 259, 260, 342

See application file for complete search history.

(56) References Cited

U.S. PATENT DOCUMENTS

| | | | | |
|---|---|---|---|---|
| 5,915,986 | A * | 6/1999 | Maejima | H01R 13/62905 439/259 |
| 6,099,346 | A * | 8/2000 | Hashiguchi | H01R 12/88 439/260 |
| 6,224,411 | B1 * | 5/2001 | Maag | H01R 13/193 439/259 |
| 6,663,409 | B1 * | 12/2003 | Liao | H01R 12/88 439/135 |
| 7,056,140 | B1 * | 6/2006 | Jiang | H01R 12/88 439/342 |
| 7,674,114 | B2 * | 3/2010 | Tanaka | H01R 12/57 439/74 |
| 8,465,328 | B2 | 6/2013 | Iida et al. | |
| 8,998,624 | B2 * | 4/2015 | Ida | H01R 13/40 439/74 |
| 2015/0180148 | A1 * | 6/2015 | Hashiguchi | H01R 12/716 439/74 |
| 2015/0280338 | A1 * | 10/2015 | Komoto | H01R 12/716 439/670 |

FOREIGN PATENT DOCUMENTS

JP 2012124040 A 6/2012

* cited by examiner

*Primary Examiner* — Chandrika Prasad
(74) *Attorney, Agent, or Firm* — Holtz, Holtz & Volek PC

(57) ABSTRACT

A connector that can satisfy the two requirements of improving workability in connecting and removing the connector, and securing connection strength. A fitting portion of the connector, which is inserted in a hole formed in a FPC, is configured to be flexible. The fitting portion is flexed to thereby make it possible to insert the fitting portion into the hole of the FPC by a small insertion force, and the fitting portion is elongated to thereby make it possible to press two contact portions provided thereon against a first terminal portion and a second terminal portion provided in the hole of the FPC, respectively.

20 Claims, 18 Drawing Sheets

CONNECTOR HAVING A FLEXIBLE FITTING PORTION TO CONNECT AND DISCONNECT TWO OBJECTS

BACKGROUND OF THE INVENTION

1. Field of the Invention

This invention relates to a connector.

2. Description of the Related Art

Conventionally, as shown in FIGS. 16 to 18, there has been proposed a connector assembly 901 comprised of a male connector 910 and a female connector 920 (see Japanese Laid-Open Patent Publication (Kokai) No. 2012-124040).

The female connector 920 includes a rectangular board body 928, an insulating film 929 provided on the board body 928, and a plurality of conductor circuits 922 and a pair of annular pads 926 provided on the insulating film 929.

The board body 928 is formed with a plurality of through holes 924, a pair of holes 925C, and a pair of holes 927. Each of the through holes 924, the holes 925C, and the holes 927 is a hole extending through the board body 928. The holes 927 are arranged at diagonally opposite locations on the board body 928, respectively.

The whole surface of one side of the board body 928 and part of the surface of the other side of the same are covered with the insulating film 929, and most of the surface of the other side of the board body 928 is exposed to the outside. Therefore, one opening of each through hole 924, one opening of each hole 925C, and one opening of each hole 927 are covered with the insulating film 929, and the other opening of each through hole 924, the other opening of each hole 925C, and the other opening of each hole 927 are open to the outside.

A cross-shaped pad 922A located at one end of each conductor circuit 922 and the one opening of each through hole 924 are opposed to each other with the insulating film 929 therebetween. The cross-shaped pad 922A and a portion of the insulating film 929 opposed to the cross-shaped pad 922A are formed with a cross-shaped slit 923 communicating with the through hole 924. The holes 925C are located at opposite end portions of the board body 928 in a longitudinal direction of the board body 928, and the holes 927 are located in the vicinity of the holes 925C, respectively. Each annular pad 926 and the one opening of each hole 925C associated therewith are opposed to each other with the insulating film 929 therebetween. The annular pad 926 and a portion of the insulating film 929 opposed to the annular pad 926 are formed with a substantially cross-shaped slit 925A communicating with the hole 925C. A central portion of the slit 925A forms a circular opening 925B.

The male connector 910 includes a rectangular base board 911, a plurality of conductor circuits 912 and a pair of conductor circuits 918 provided on the base board 911, a columnar bump 913 provided on an annular pad 912A located at one end of each conductor circuit 912, a first guide protrusion 915 provided on an annular pad 918A located at an intermediate portion of each conductor circuit 918, and a second guide protrusion 917 provided in the vicinity of the first guide protrusion 915. The first guide protrusions 915 are located at opposite end portions of the base board 911 in a longitudinal direction of the base board 911. The pair of first guide protrusions 915 each have a neck portion 915A and a mushroom cap-shaped head portion 915B (see FIG. 18). The pair of second guide protrusions 917 are disposed at diagonally opposite locations on the base board 911. Each second guide protrusion 917 is equal in protrusion height to each columnar bump 913. Each first guide protrusion 915 is larger in protrusion height than each second guide protrusion 917.

To connect the male connector 910 and the female connector 920, first, a front surface 911A of the male connector 910 and a front surface 921A of the female connector 920 are set such that they are opposed to each other. At this time, the pair of first guide protrusions 915 and the pair of annular pads 926 are set such that they are opposed to each other. Then, the female connector 920 is pressed against the male connector 910. At this time, first, the first guide protrusions 915 are inserted into the holes 925C through the slits 925A, respectively. Next, the second guide protrusions 917 are inserted into the holes 927 through the slits 927A, respectively, and the columnar bumps 913 are inserted into the through holes 924 through the cross-shaped slits 923, respectively. As a result, the cross-shaped pads 922A of the female connector 920 are brought into contact with the columnar bumps 913 of the male connector 910 and the annular pads 912A provided thereon, whereby the conductor circuits 922 and the conductor circuits 912 are electrically, respectively.

In the above-described connector assembly 901, to connect the male connector 910 and the female connector 920 to each other, first, it is necessary to set the front surface 911A of the male connector 910 and the front surface 921A of the female connector 920 such that they are opposed to each other, and then insert the first guide protrusions 915 into the holes 925C, respectively. However, a reverse side 921B of the female connector 920 is mounted on an object to be connected, such as a circuit board, not shown, and hence it is not easy to position the first guide protrusions 915 and the holes 925C (annular pads 926), which results in lowered workability.

Further, a fairly large insertion force is required to insert the first guide protrusions 915 into the holes 925C and then further insert the second guide protrusions 917 into the holes 927 and at the same time the columnar bumps 913 into the through holes 924 (cross-shaped pads 922A). Therefore, during operation for connecting the male connector 910 and the female connector 920 to each other, the male connector 910 and the female connector 920 are bent, and the circuit board on which the male connector 910 is mounted and the circuit board on which the female connector 920 is mounted are bent, which results in lowered workability.

SUMMARY OF THE INVENTION

The present invention has been made in view of these circumstances, and an object thereof is to provide a connector that can satisfy the two requirements of improving workability in connecting and removing the connector, and securing connection strength.

To attain the above object, the present invention provides a connector that is disposed between a first object to be connected and a second object to be connected, and connects the first object to be connected and the second object to be connected, comprising an insulating member including a first base portion, a second base portion arranged in opposed relation to the first base portion, a first supporting portion that extends from the first base portion, a second supporting portion that extends from the second base portion, and a fitting portion that is flexible and is supported by the first supporting portion and the second supporting portion, and is fitted in a hole formed in the first object to be connected, and a conductive path provided on the insulating member and including a connection portion that is provided on at least one of the first base portion and the second base portion, and is connected to the second object to be connected, a contact portion that is provided on the fitting portion, and is brought into contact with a terminal portion of the first object to be connected, which is provided in an inner surface of the hole, and a conductive path-side integral connection portion that integrally connects the connection portion and the contact portion, wherein the fitting portion can be switched, by flexing thereof, between a fitted state in which the fitting portion is fitted in the hole such that the contact portion is pressed against the terminal portion, and a removal enabling state in which the fitted state is released such that the first object to be connected can be removed from the fitting portion.

Preferably, a plurality of the first supporting portions, a plurality of the second supporting portions, and a plurality of the fitting portions are arranged in a longitudinal direction of the first base portion, respectively, respective positions of the first supporting portions and respective positions of the second supporting portions matching in the longitudinal direction, and the respective positions of the first supporting portions and respective positions of the fitting portions being shifted from each other in the longitudinal direction.

Preferably, the first supporting portion includes a hinge portion which is bendable; the fitting portion includes a pair of fitting portion bodies, and a fitting portion-side integral connection portion that connects the pair of the fitting portion bodies in such a manner that the pair of the fitting portion bodies are aligned in an intersecting direction intersecting with the longitudinal direction and a direction of fitting the fitting portion in the hole; one fitting portion body of the pair of the fitting portion bodies is connected to front end portions of two adjacent ones of the first supporting portions in a manner sandwiched therebetween in the longitudinal direction; the other fitting portion body of the pair of the fitting portion bodies is connected to front end portions of two adjacent ones of the second supporting portions in a manner sandwiched therebetween in the longitudinal direction; when the fitting portion in an elongated state is flexed, a linear distance in the intersecting direction between one end and the other end of part of the fitting portion toward the first object to be connected becomes shorter than a length of the hole in the intersecting direction, whereby the contact portion is moved away from the terminal portion, and the fitting portion is put in the removal enabling state; and when the fitting portion in a flexed state is elongated, the linear distance becomes longer than when the fitting portion is in the removal enabling state, whereby the fitting portion is fitted in the hole, and the contact portion is pressed against the terminal portion, to put the fitting portion in the fitted state.

More preferably, when the fitting portion is in the removal enabling state, the fitting portion-side integral connection portion is at a location closer in the fitting direction to the second object to be connected than the hinge portion is, and when the fitting portion is in the fitted state, the fitting portion-side integral connection portion is at a location closer in the fitting direction to the first object to be connected than the hinge portion is.

More preferably, the fitting portion includes a fitting portion-side protruding portion that is provided on one of an end of one of the pair of the fitting portion bodies, toward the first base portion, and an end of the other of the pair of the fitting portion bodies, toward the second base portion, and is hooked on a to-be-connected object-side protruding portion provided on the inner surface of the hole when in the fitted state.

More preferably, the fitting portion includes a fitting portion-side protruding portion that is provided on both of an end of one of the pair of the fitting portion bodies, toward the first base portion, and an end of the other of the pair of the fitting portion bodies, toward the second base portion, and is hooked on a to-be-connected object-side protruding portion provided on the inner surface of the hole when in the fitted state.

More preferably, the fitting portion includes a first fitting portion-side inclined surface that is provided on an end of one of the pair of the fitting portion bodies, toward the first base portion, and is brought into contact with a first to-be-connected object-side inclined surface that is provided on the inner surface of the hole in the fitted state.

More preferably, the fitting portion includes a first fitting portion-side inclined surface that is provided on an end of one of the pair of the fitting portion bodies, toward the first base portion, and is brought into contact with a first to-be-connected object-side inclined surface that is provided on the inner surface of the hole, when in the fitted state, and a second fitting portion-side inclined surface that is provided on an end of the other of the pair of the fitting portion bodies, toward the second base portion, and is brought into contact with a second to-be-connected object-side inclined surface that is provided on the inner surface of the hole, when in the fitted state.

More preferably, the insulating member includes an arm portion that extends from at least one of the pair of the fitting portion bodies toward the first base portion or the second base portion, and is pressed by the first object to be connected when the fitting portion and the hole are fitted, to thereby elongate the fitting portion.

Further preferably, when the fitting portion is in the removal enabling state, a free end portion of the arm portion is at a location closer in the fitting direction to the first object to be connected than the first base portion or the second base portion is, and when the fitting portion is in the fitted state, the free end portion of the arm portion is received between the two adjacent ones of the first supporting portions or between the two adjacent ones of the second supporting portions.

More preferably, the plurality of the first supporting portions are integrally connected via one of the pair of the fitting portion bodies, and the plurality of second supporting portions are integrally connected via the other of the pair of the fitting portion bodies.

According to the present invention, it is possible to provide a connector that can satisfy the two requirements of improving workability in connecting and removing the connector and securing connection strength.

The above and other objects, features and advantages of the present invention will become more apparent from the following detailed description taken in conjunction with the accompanying drawings.

BRIEF DESCRIPTION OF THE DRAWINGS

FIGS. 7A and 7B are conceptual views showing part of the connector appearing in FIG. 1, in which FIG. 7A illustrates the removal enabling state, and FIG. 7B illustrates the fitted state;

DETAILED DESCRIPTION OF THE PREFERRED EMBODIMENT

The present invention will now be described in detail with reference to the drawings showing preferred embodiments thereof.

Figure 1:
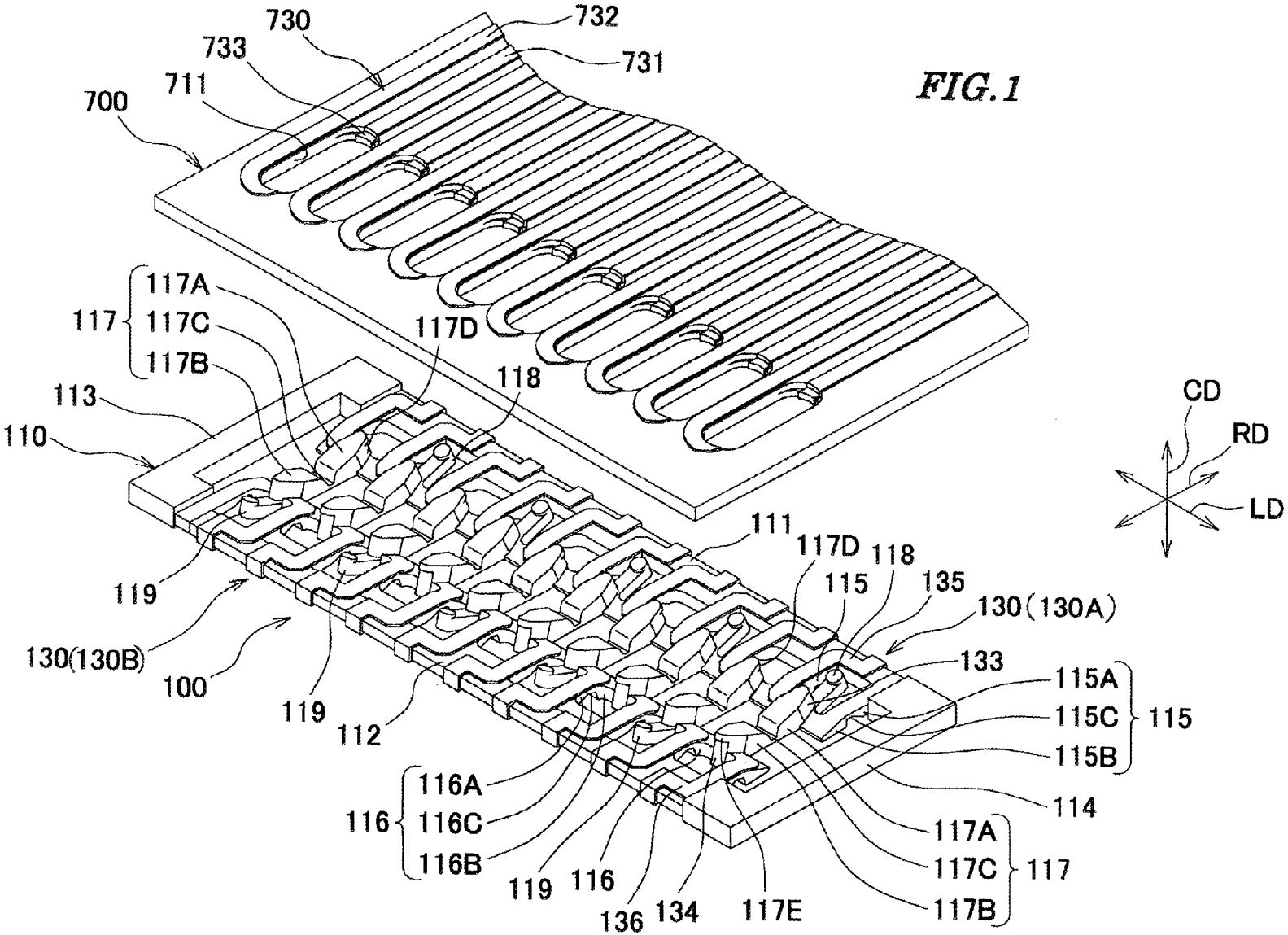
FIG. 1 is a perspective view of a connector according to an embodiment of the present invention and an FPC in a state before they are connected to each other.

As shown in FIG. 1, a connector 100 is disposed between an FPC (first object to be connected) 700 and a printed circuit board (second object to be connected), not shown, and electrically connects the FPC 700 and the printed circuit board. The connector 100 is mounted on the printed circuit board.

Figure 10:
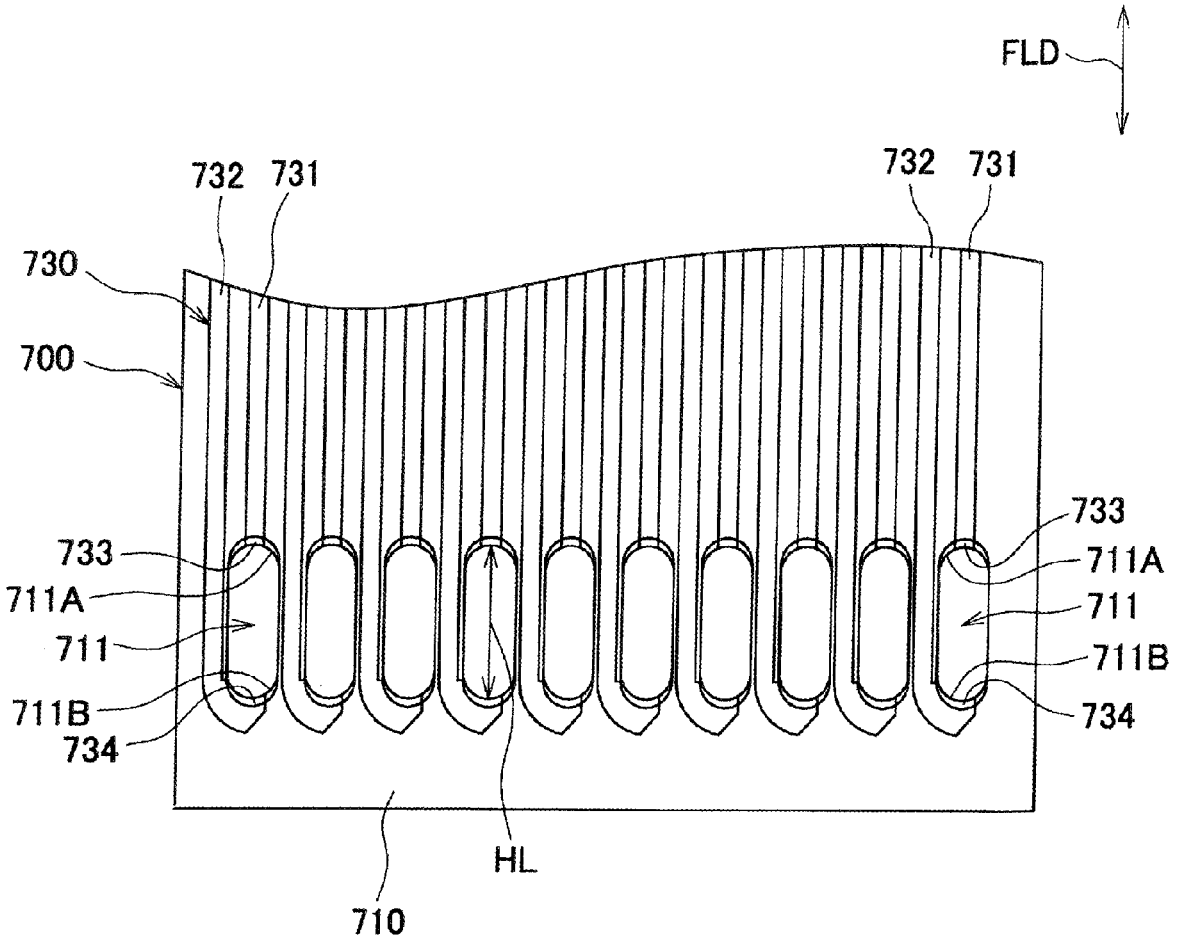
FIG. 10 is a partial plan view of the FPC appearing in FIG. 1.

As shown in FIG. 10, the FPC 700 includes an insulating film 710 and a conductive path pattern 730. One end of the insulting film 710 is formed with substantially oval holes 711. Each hole 711 extends in a longitudinal direction FLD of the FPC 700. Each hole 711 is formed with a first protruding portion (to-be-connected object-side protruding portion) 711A (see FIG. 10) and a second protruding portion (to-be-connected object-side protruding portion) 711B (see FIG. 10) at respective lower portions (see FIG. 5) of an inner surface (inner peripheral surface) thereof. The first protruding portion 711A and the second protruding portion 711B are opposed to each other in the longitudinal direction FLD of the FPC 700.

The conductive path pattern 730 includes a plurality of first conductive paths 731, a plurality of second conductive paths 732, a plurality of first terminal portions (terminal portions of the first object to be connected) 733, and a plurality of second terminal portions (terminal portions of the first object to be connected) 734. The first conductive paths 731 extend in the longitudinal direction FLD of the FPC 700. One end of each first conductive path 731 reaches one end of an associated one of the holes 711. The second conductive paths 732 extend in parallel with the first conductive paths 731. One end of each second conductive path 732 reaches the other end of an associated one of the holes 711. Each first terminal portion (terminal portion) 733 extends from an upper end of the inner surface of an associated one of the holes 711, passing the first protruding portion 711A, to a lower end of the inner surface of the associated hole 711 (see FIGS. 5 and 6). The first terminal portions 733 are connected to the first conductive paths 731, respectively. Each second terminal portion (terminal portion) 734 extends from the upper end of the inner surface of an associated one of the holes 711, passing the second protruding portion 711B, to the lower end of the inner surface of the associated hole 711. The second terminal portions 734 are connected to the second conductive paths 732, respectively.

Figure 3:
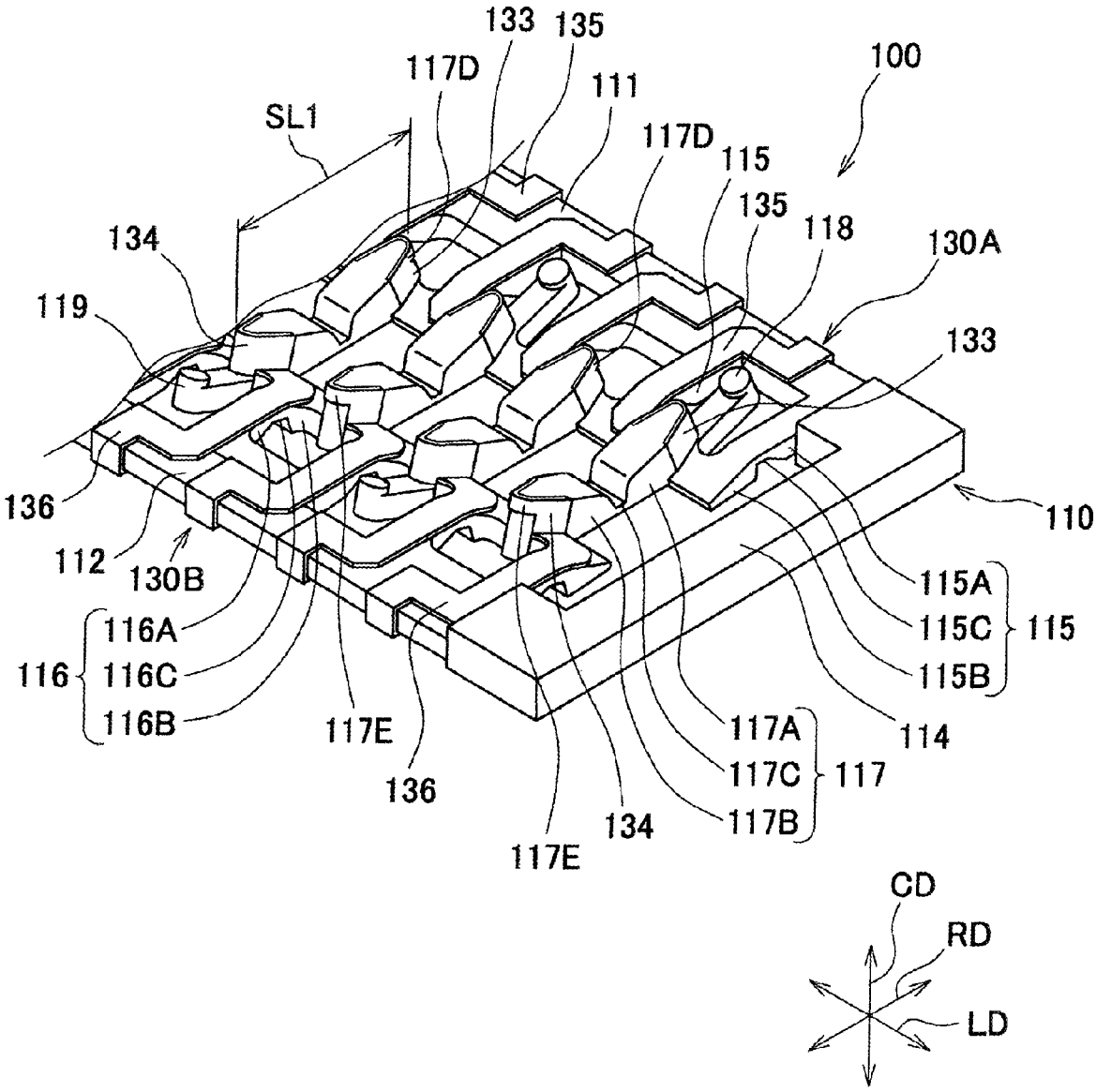
FIG. 3 is a partial enlarged perspective view of the connector appearing in FIG. 1.
Figure 4:
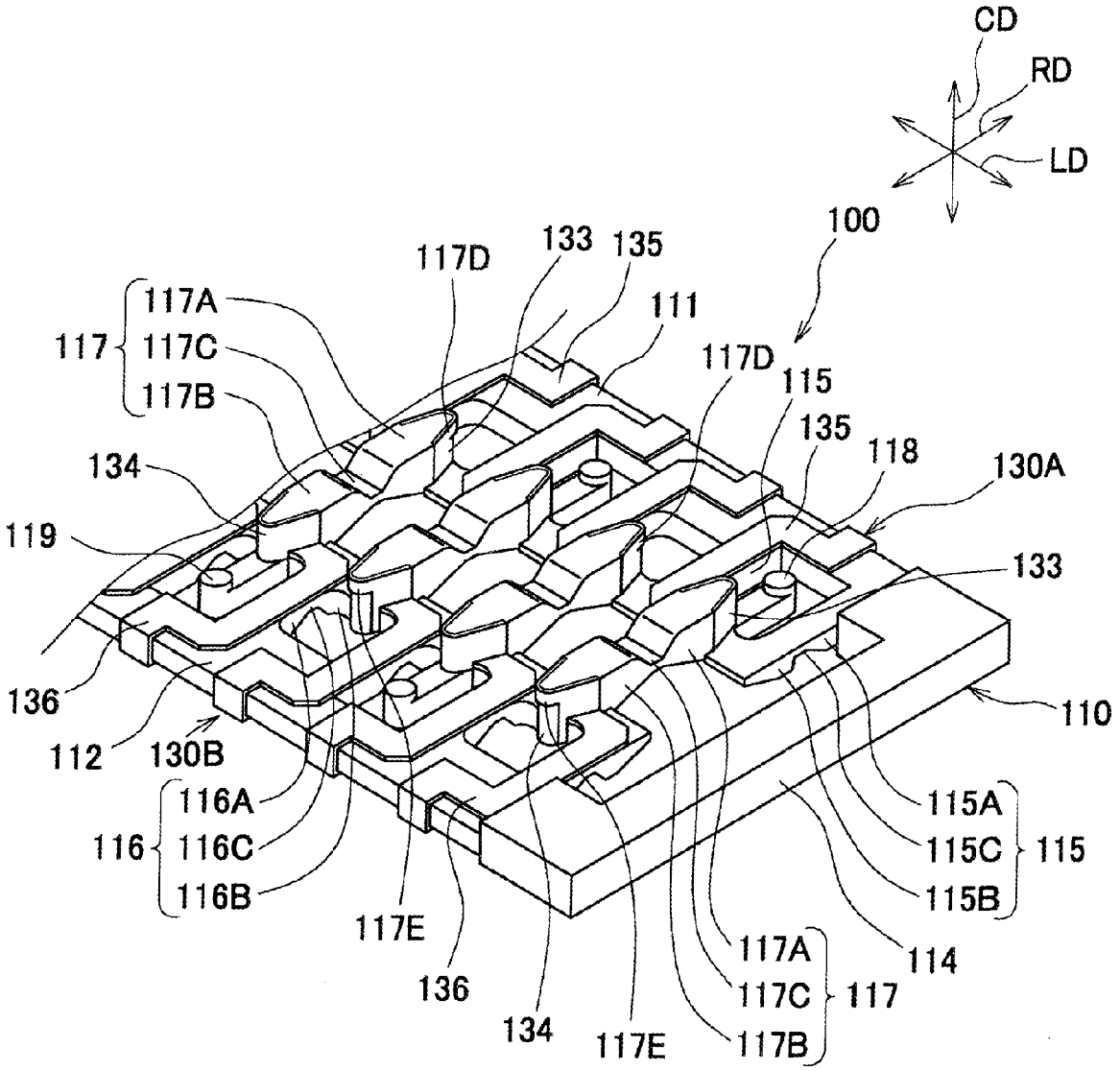
FIG. 4 is a partial enlarged perspective view the connector shown in FIG. 3 in a state in which fitting portions of the connector are each changed from a removal enabling state to a fitted state.

As shown in FIGS. 1, 3 and 4, the connector 100 includes an insulating member 110, and a plurality of conductive paths 130 provided on the insulating member 110.

Figure 2:
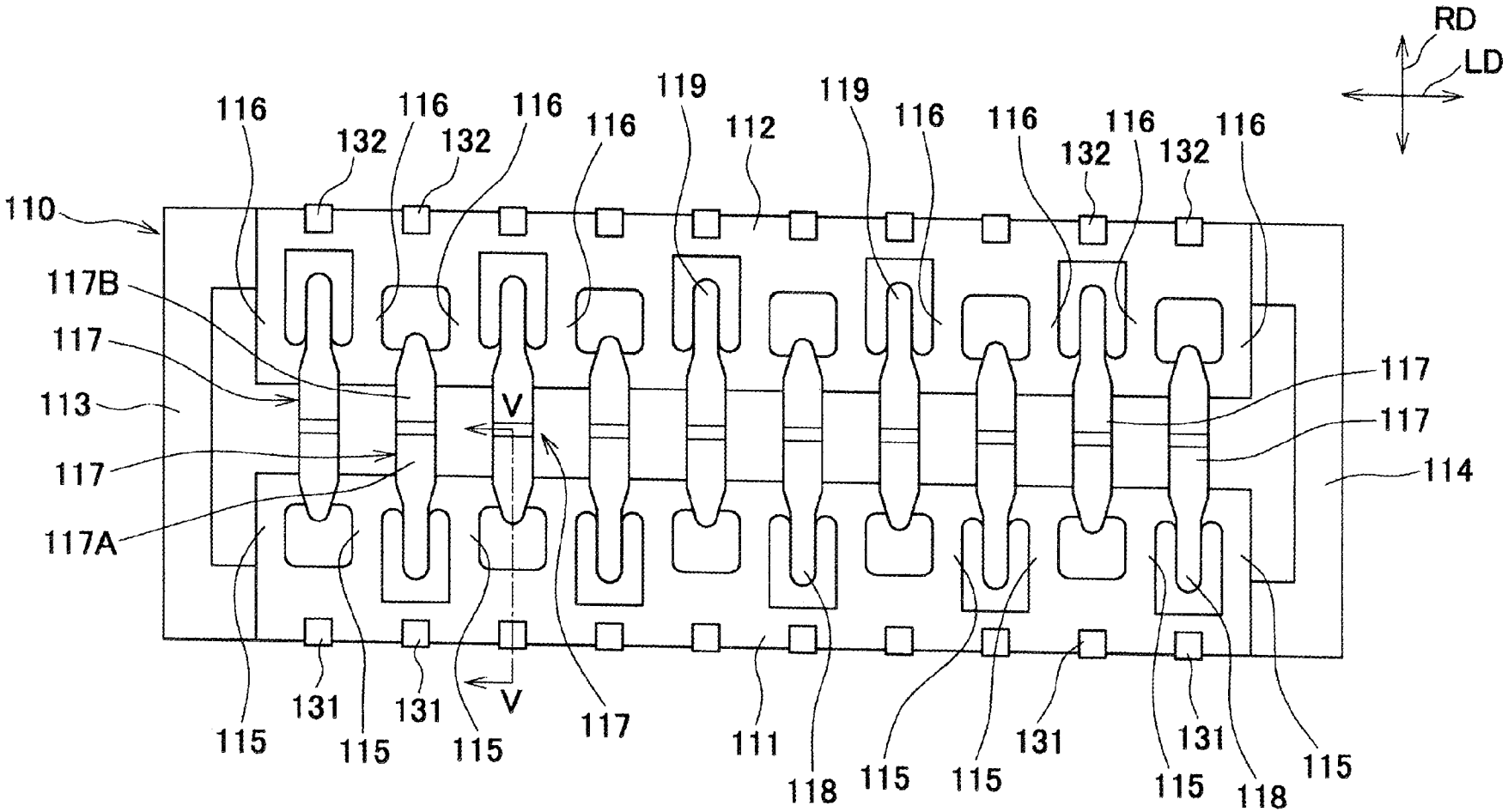
FIG. 2 is a bottom view of the connector appearing in FIG. 1.

As shown in FIG. 2, the insulating member 110 includes a first base portion 111, a second base portion 112, a first connecting portion 113, a second connecting portion 114, a plurality of first supporting portions 115, a plurality of second supporting portions 116, a plurality of fitting portions 117, a plurality of arm portions 118, and a plurality of arm portions 119. The insulating member 110 is integrally molded of synthetic resin, and has flexibility.

The first base portion 111 has a long plate-like shape. The second base portion 112 has the same shape as the first base portion 111, and is arranged in substantially parallel (in opposed relation) to the first base portion 111. The first connecting portion 113 connects one end of the first base portion 111 and one end of the second base portion 112. The second connecting portion 114 connects the other end of the first base portion 111 and the other end of the second base portion 112.

The plurality of first supporting portions 115, the plurality of second supporting portions 116, and the plurality of fitting portions 117 are each arranged in a longitudinal direction LD of the first base portion 111. The positions of the plurality of first supporting portions 115 and the positions of the plurality of second supporting portions 116 match in the longitudinal direction LD, and the positions of the first supporting portions 115 and the positions of the fitting portions 117 are shifted from each other in the longitudinal direction LD. Each fitting portion 117 is located between two adjacent ones of the first supporting portions 115 in the longitudinal direction LD. Each first supporting portion 115 located between two adjacent ones of the fitting portions 117 in the longitudinal direction LD is integrally connected to each of the two adjacent fitting portions 117. Each second supporting portion 116 located between two adjacent ones of the fitting portions 117 in the longitudinal direction LD is also integrally connected to each of the two adjacent fitting portions 117. The plurality of first supporting portions 115 are integrally connected via first fitting portion bodies (one fitting portion bodies) 117A, and the plurality of second supporting portions 116 are integrally connected via second fitting portion bodies (the other fitting portion bodies) 117B.

The fitting portions 117 are flexible, and are supported by the first supporting portions 115 and the second supporting portions 116. The fitting portions 117 are fitted in the holes 711 of the FPC 700, respectively.

As shown in FIGS. 1 to 6, the plurality of conductive paths 130 are formed by first conductive paths 130A each including a connection portion 131, a contact portion 133, and an integral connection portion (conductive path-side integral connection portion) 135, and second conductive paths 130B each including a connection portion 132, a contact portion 134, and an integral connection portion (conductive path-side integral connection portion) 136. Each pair of the first and second conductive paths 130A and 130B are provided in a manner corresponding to each pair of the first and second conductive paths 731 and 732 of the EPC 700, respectively. More specifically, the connection portion 131 is provided on a bottom surface of the first base portion 111, and is connected to a terminal portion (not shown) of the printed circuit board. The connection portion 132 is provided on a bottom surface of the second base portion 112, and is connected to a terminal portion (not shown) of the printed circuit board. The contact portions 133 and 134 are provided on an associated one of the fitting portions 117, and are brought into contact with an associated one of the first terminal portion 733 and an associated one of the second terminal portion 734 of the FPC 700, respectively. The integral connection portion 135 integrally connects the connection portion 131 and the contact portion 133. The integral connection portion 136 integrally connects the connection portion 132 and the contact portion 134.

The fitting portion 117 can be switched between two states: a fitted state (see FIGS. 4 and 6) in which the fitting portion 117 is firmly fitted in the associated hole 711 of the FPC 700 such that the contact portions 133 and 134 provided thereon are pressed against the first terminal portion 733 and the second terminal portion 734, associated therewith, (see FIG. 10) of the FPC 700, respectively, and a removal enabling state (see FIGS. 3 and 5) in which the contact portions 133 and 134 are moved away from the first terminal portion 733 and the second terminal portion 734 of the FPC 700, respectively, such that the FPC 700 can be removed from the fitting portions 117. In the present embodiment, the fitting portions 117 are flexed in the removal enabling state, and are elongated (extend straight) in the fitted state.

Each first supporting portion 115 includes a supporting portion body 115A, a movable piece (front end portion of the first supporting portion 115) 115B, and a hinge portion 115C. The supporting portion body 115A extends from the first base portion 111 toward the second base portion 112. The movable piece 115B is L-shaped in plan view. The hinge portion 115C connects one end of the movable piece 115B and one end of the supporting portion body 115A. The hinge portion 115C is thinner than the supporting portion body 115A and the movable piece 115B, and hence the movable piece 115B is pivotally movable about a virtual line (straight line parallel to the longitudinal direction LD (not shown)) passing the hinge portion 115C.

Each second supporting portion 116 includes a supporting portion body 116A, a movable piece 116B, and a hinge portion 116C. The supporting portion body 116A extends from the second base portion 112 toward the first base portion 111. The movable piece 116B is L-shaped in plan view. The hinge portion 116C connects one end of the movable piece 116B and one end of the supporting portion body 116A. The hinge portion 116C is thinner than the supporting portion body 116A and the movable piece 116B, and hence the movable piece 116B is pivotally movable about a virtual line (straight line parallel to the longitudinal direction LD (not shown)) passing the hinge portion 116C.

The hinge portions 115C and 116C can be bent in a fitting direction CD (direction in which the fitting portions 117 are fitted in the holes 711 of the FPC 700), but may be elastically deformable not only in the fitting direction CD, but also in an intersecting direction RD perpendicular to the longitudinal direction LD and the fitting direction CD (may be compressible in the intersecting direction RD of the hinge portions 115C and 116C).

Each fitting portion 117 includes the first fitting portion body 117A, the second fitting portion body 117B, and a integral connection portion (fitting portion-side integral connection portion) 117C. The first fitting portion body 117A is substantially wedge-shaped (see FIGS. 5 and 6), and is integrally connected to the movable pieces 115B in a manner sandwiched between the other ends of the movable pieces 115B of the two first supporting portions 115 adjacent to each other in the longitudinal direction LD. The second fitting portion body 117B is substantially wedge-shaped, and is integrally connected to the movable pieces 116B in a manner sandwiched between the other ends of the movable pieces 116B of the two second supporting portions 116 adjacent to each other in the longitudinal direction LD. The integral connection portion 117C integrally connects the first fitting portion body 117A and the second fitting portion body 117B. The first fitting portion body 117A and the second fitting portion body 117B are aligned in the intersecting direction RD. The integral connection portion 117C is thinner than the first fitting portion body 117A and the second fitting portion body 117B, and hence the fitting portion 117 is flexible using the integral connection portion 117C as a joint. Although in the above-described embodiment, the intersecting direction RD in which the first and second fitting portion bodies 117A and 117B are aligned is a direction perpendicular to the longitudinal direction LD and the fitting direction CD, the intersecting direction RD may be a direction obliquely intersecting with the longitudinal direction LD and the fitting direction CD.

The first fitting portion bodies 117A of respective even-numbered fitting portions 117 counted from the fitting portion 117 closest to one end of the insulating member 110 (the fitting portion 117 at the right end, as viewed in FIG. 1) are each formed with a first protruding portion (fitting portion-side protruding portion) 117D, and the second fitting portion bodies 117B of respective odd-numbered fitting portions 117 counted from the fitting portion 117 closest to the one end of the insulating member 110 are each formed with a second protruding portion (fitting portion-side protruding portion) 117E. The first protruding portion 117D is located at an upper portion of an end of the first fitting portion body 117A toward the first base portion 111, and the second protruding portion 117E is located at an upper portion of an end of the second fitting portion body 117B toward the second base portion 112.

Further, the first fitting portion bodies 117A of the respective odd-numbered fitting portions 117 counted from the fitting portion 117 closest to the one end of the insulating member 110 are each formed with the arm portion 118, and the second fitting portion bodies 117B of the respective even-numbered fitting portions 117 counted from the fitting portion 117 closest to the one end of the insulating member 110 are each formed with the arm portion 119. The arm portion 118 extends from a lower portion of the end of the first fitting portion body 117A toward the first base portion 111, and is located between the first supporting portions 115 adjacent to each other in the longitudinal direction LD. The arm portion 119 extends from a lower portion of the end of the second fitting portion body 117B toward the second base portion 112, and is located between the second supporting portions 116 adjacent to each other in the longitudinal direction LD.

In the fitted state, the first protruding portions 117D of the first fitting portion bodies 117A are hooked on the first protruding portions 711A of the holes 711 of the FPC 700, respectively (see FIG. 6), and the second protruding portions 117E of the second fitting portion bodies 117B are hooked on the second protruding portions 711B of the holes 711 of the FPC 700, respectively (see FIG. 10).

Each first fitting portion body 117A is formed with the contact portion 133 on a surface thereof toward the first base portion 111, and each second fitting portion body 117B is formed with the contact portion 134 on a surface thereof toward the second base portion 112.

Figure 7A:
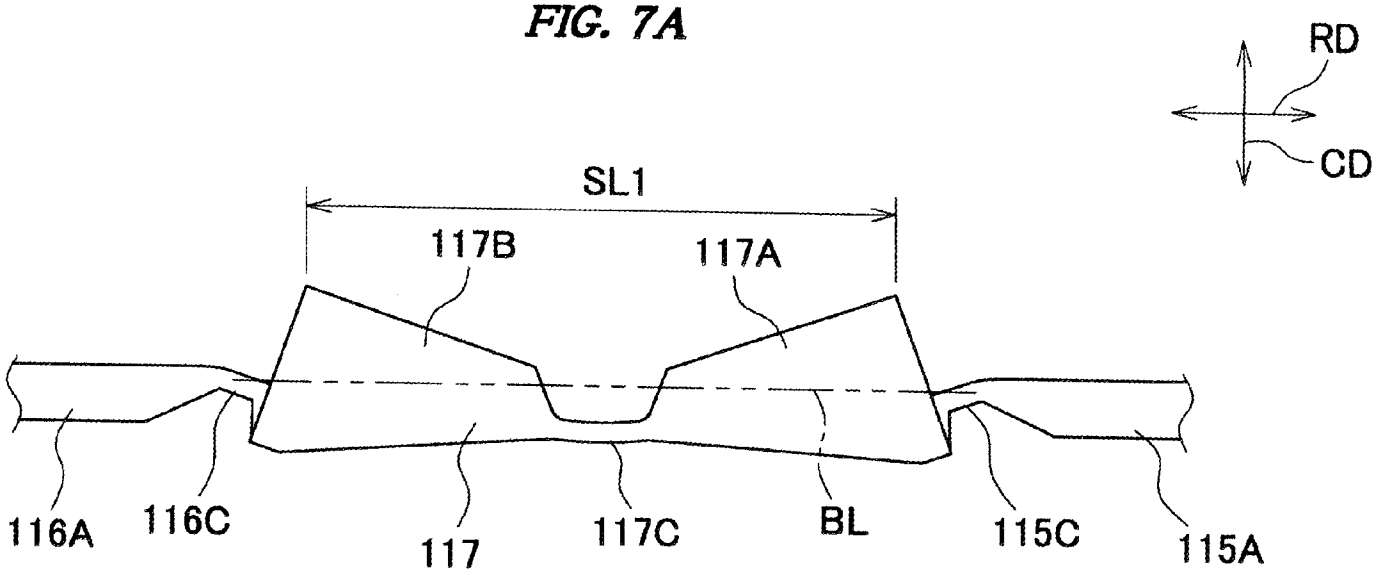

To connect the FPC 700 to the connector 100 mounted on the printed circuit board, first, the fitting portions 117, if in the elongated state (see FIG. 4), are flexed by pushing the central portions thereof downward (in a direction toward the printed circuit board) e.g. with a finger or a jig (not shown) to thereby put the fitting portions 117 in the state in which the FPC 700 can be removed (see FIG. 3). As shown in FIG. 7A, when the fitting portions 117 are in this removal enabling state, each fitting portion 117 is flexed, and a linear distance SL1 (see FIG. 7A) integrally connecting between one end and the other end of part, toward the FPC 700 (part toward the first object to be connected), of the fitting portion 117 in the intersecting direction RD is shorter than a length HL (see FIG. 10) of each hole 711 in the intersecting direction RD, and hence when connecting the FPC 700 and the connector 100, interference between the fitting portions 117 and the peripheries of the associated holes 711 of the FPC 700 is avoided, which makes it possible to smoothly relatively insert the fitting portions 117 into the holes 711, respectively.

When each fitting portion 117 is flexed (see FIG. 3), the integral connection portion 117C is located downward (in a direction toward the printed circuit board) of the hinge portions 115C and 116C (see FIG. 7A). When each fitting portion 117 is elongated (see FIG. 4), the integral connection portion 117C is moved in the fitting direction CD to a position farther from the printed circuit board than the hinge portions 115C and 116C are (see FIG. 7B).

Figure 5:
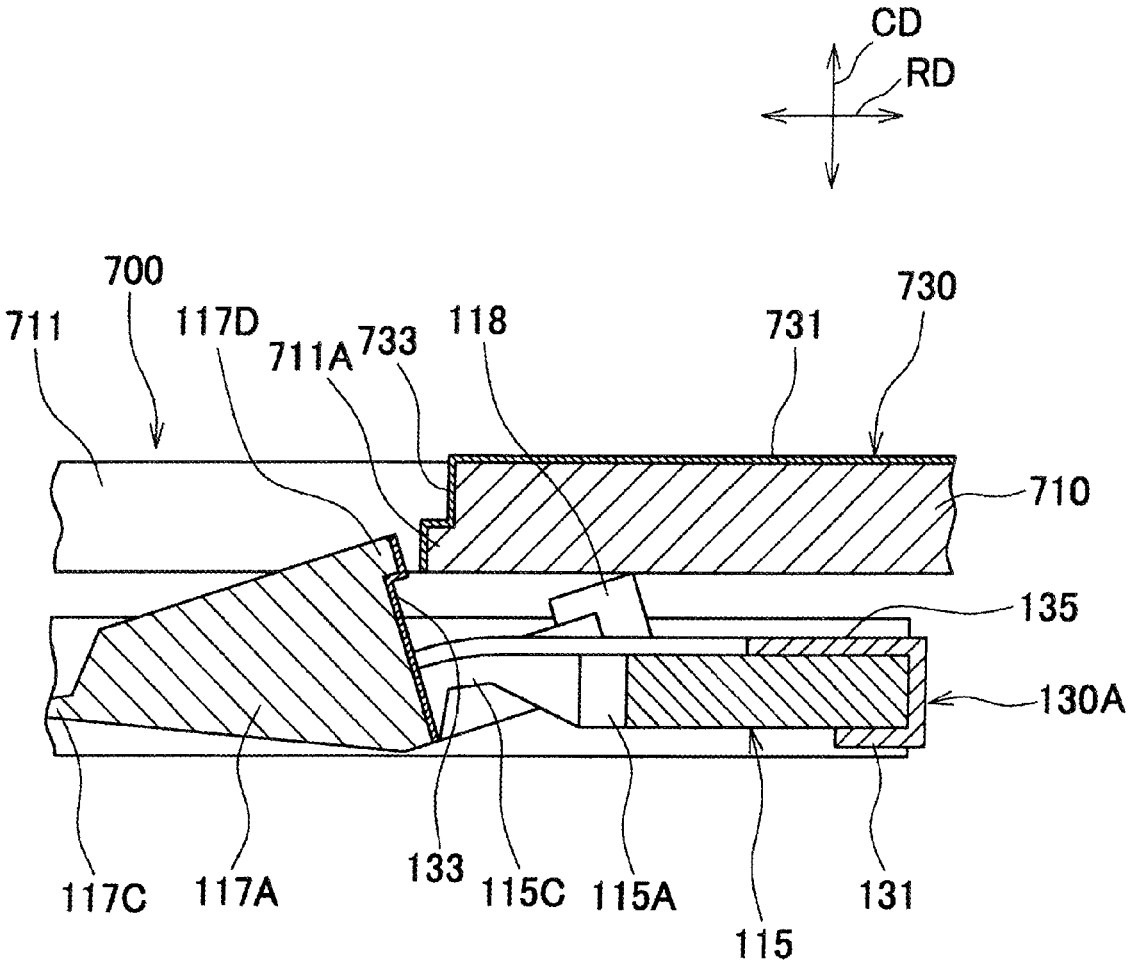
FIG. 5 is a partial cross-sectional view, taken along V-V in FIG. 2, of the connector and FPC shown in FIG. 1 in a state in which the FPC is halfway connected to the connector.
Figure 6:
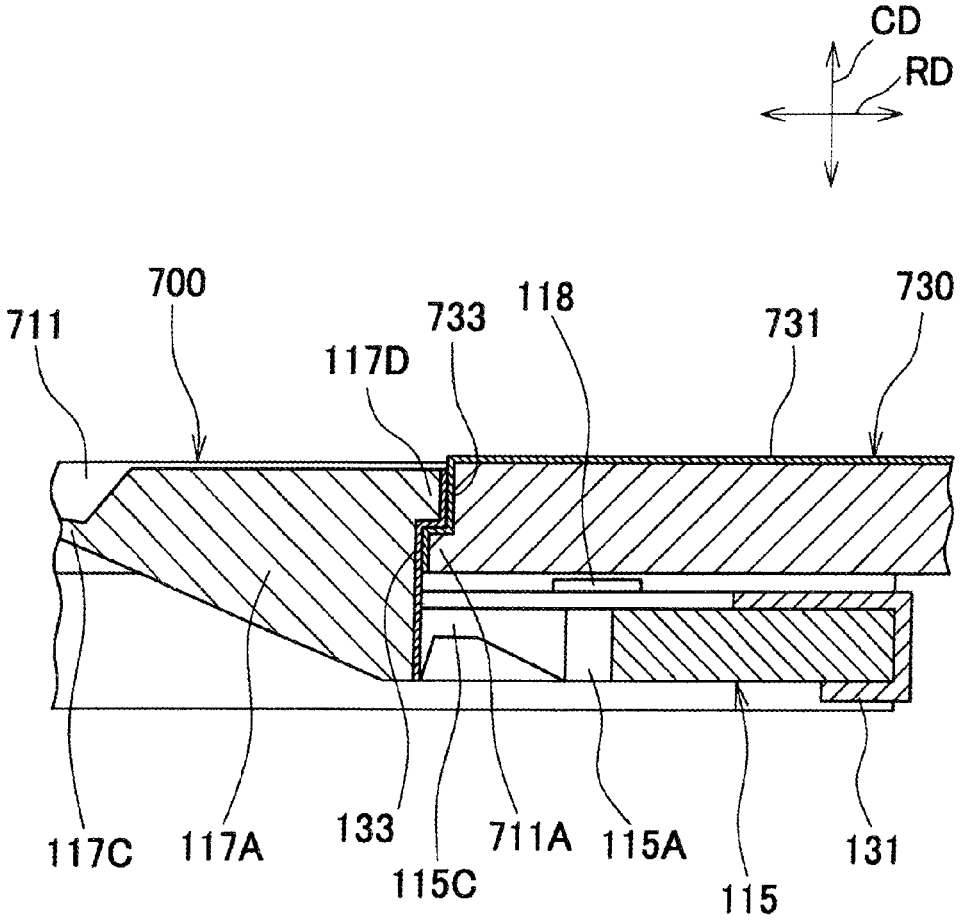
FIG. 6 is a partial cross-sectional view, taken along V-V in FIG. 2, of the connector and FPC shown in FIG. 1 in a state connected to each other.

Next, as shown in FIG. 5, the FPC 700 is positioned with respect to the connector 100 such that the holes 711 are located upward (in a direction away from the printed circuit board) of flexed fitting portions 117, respectively.

Figure 8:
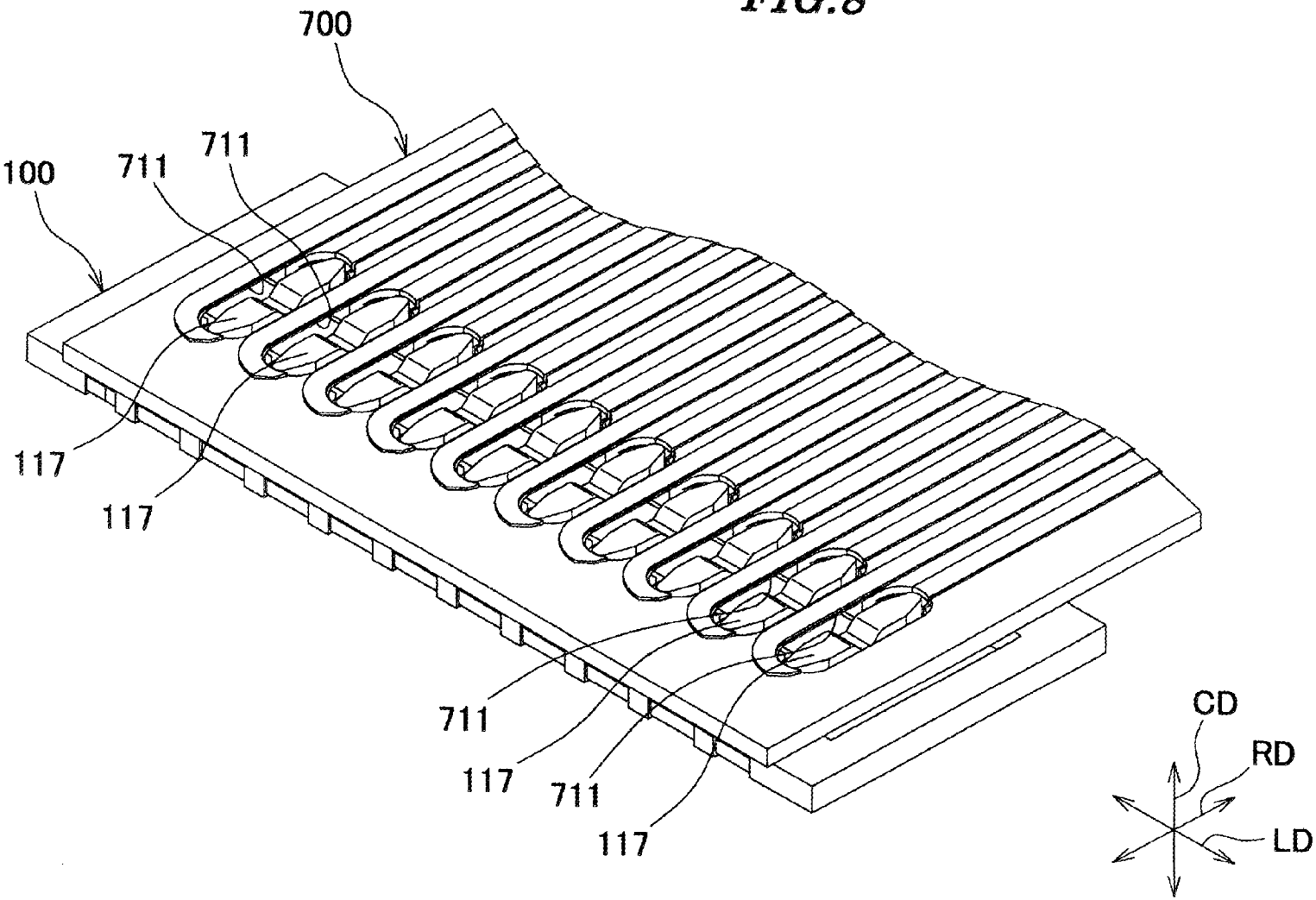
FIG. 8 is a partial perspective view of the connector and FPC shown in FIG. 1 in a state connected to each other.

Finally, the FPC 700 is moved down. That is, the FPC 700 is pressed against the surface of the printed circuit board, whereupon the fitting portions 117 are smoothly relatively inserted into the holes 711, respectively, and as the arm portions 118 and 119 are pressed via the FPC 700, the first fitting portion bodies 117A and the second fitting portion bodies 117B are pivoted, whereby the fitting portions 117 are switched to the fitted state (see FIG. 8).

When the fitting portions 117 are in the fitted state, each fitting portion 117 is elongated, and the above-mentioned linear distance SL1 becomes longer than that in the removal enabling state (see SL2 in FIG. 7B), whereby the fitting portions 117 are firmly fitted in the holes 711, respectively, and the contact portions 133 and 134 are pressed against the first terminal portions 733 and the second terminal portions 734 of the FPC 700, respectively. As a result, the FPC 700 and the printed circuit board are electrically connected via the connector 100 (see FIG. 6).

Figure 9:
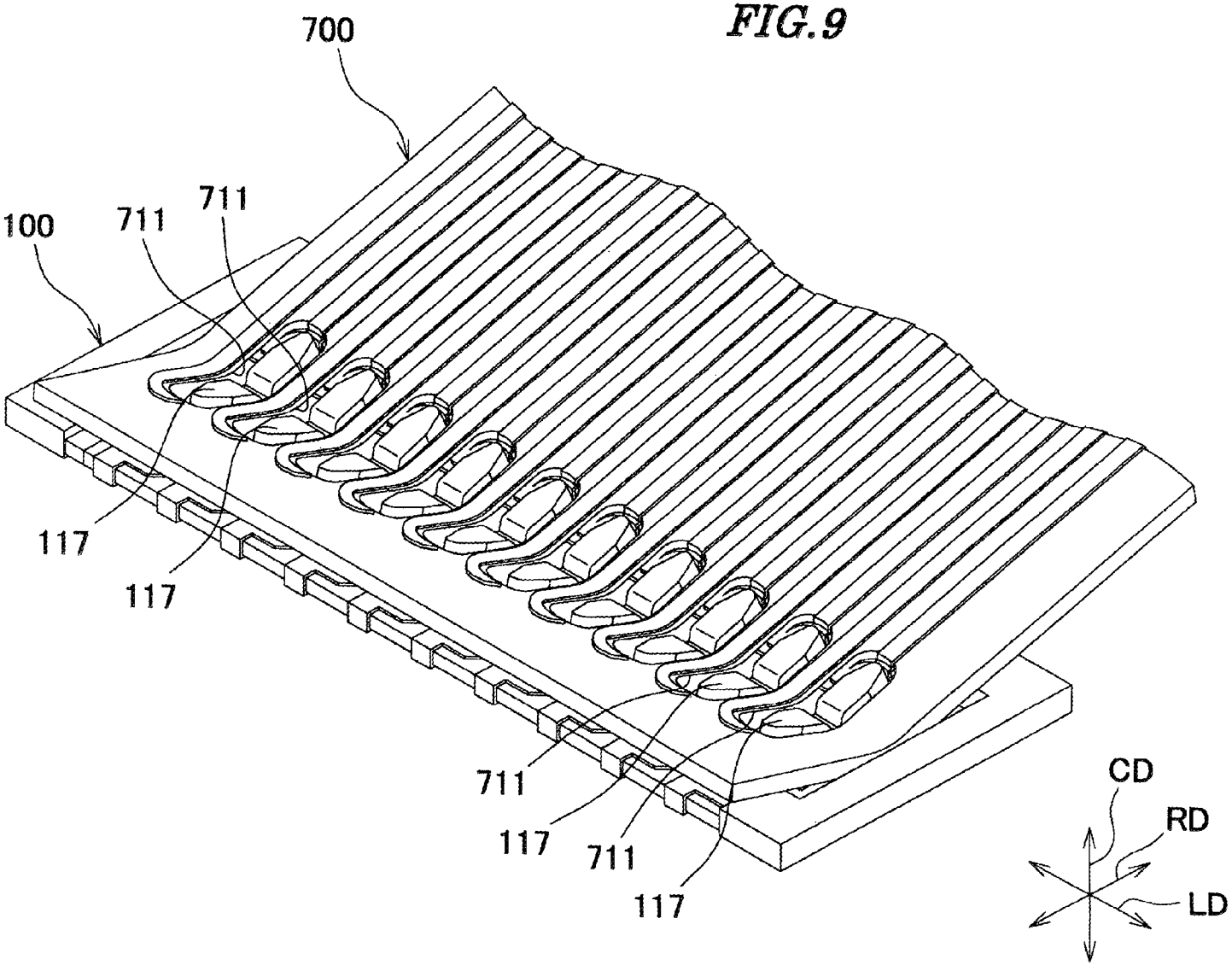
FIG. 9 is a partial perspective view of the connector and FPC shown in FIG. 1 in a state in which the fitting portions of the connector each have been changed from the fitted state to the removed state so as to cause the FPC to be removed from the connector.

Next, to remove the FPC 700 from the connector 100, first, the central portions of the fitting portions 117 in the fitted state are pushed downward e.g. with a finger or a jig to thereby put the fitting portions 117 in the removal enabling state (see FIG. 9). Then, by moving up the FPC 700, the FPC 700 can be removed from the connector 100.

Figure 7B:
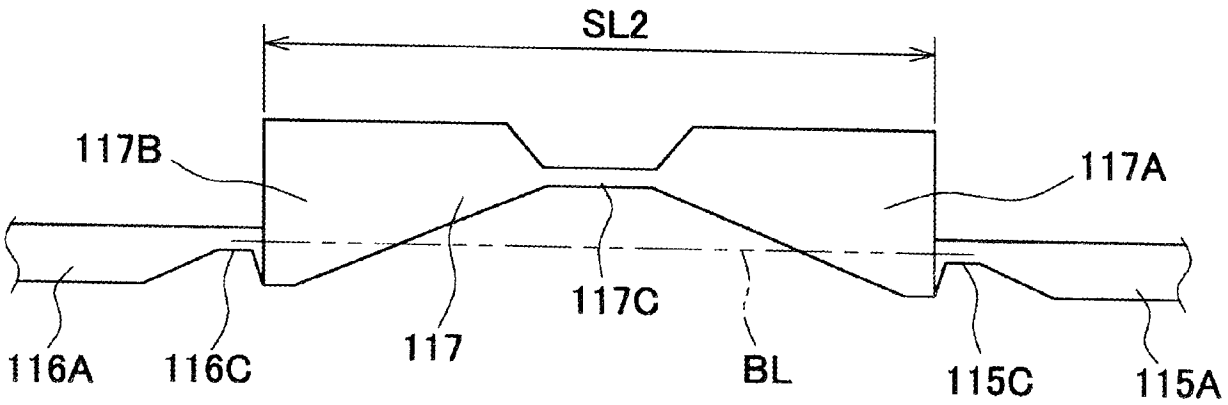

When each fitting portion 117 is changed from the fitted state shown in FIG. 7B to the removal enabling state shown in FIG. 7A, the integral connection portion 117C passes across a virtual straight line BL connecting the hinge portion 115C and the hinge portion 116C. When the integral connection portion 117C passes across the virtual straight line BL, the hinge portions 115C and 116C are bent in the fitting direction CD, and the integral connection portion 117C passes the virtual straight line BL. When the integral connection portion 117C passes the virtual straight line BL, a force in a direction of flexing the fitting portion 117 acts on the fitting portion 117, and hence the fitting portion 117 is automatically put into a flexed state (removal enabling state). Although the force of automatically flexing the fitting portion 117 is an elastic force generated when the hinge portions 115C and 116C are bent in the fitting direction CD, this force may be generated by compressing or elastically deforming the hinge portions 115C and 116C in the intersecting direction RD.

According to the present embodiment, by flexing the fitting portions 117, it is possible to insert the fitting portions 117 in the holes 711 of the FPC 700 by a small insertion force, and also remove the FPC 700 from the fitting portions 117 by a small separation force, which facilitates operations for connecting and disconnecting the connector 100 and the FPC 700. Further, the fitting portions 117 are elongated after being inserted into the holes 711 of the FPC 700, whereby the contact portions 133 and 134 can be pressed against the first terminal portions 733 and the second terminal portions 734 of the FPC 700, respectively. This makes it possible to secure high connection strength between the connector 100 and the FPC 700.

Figure 16:
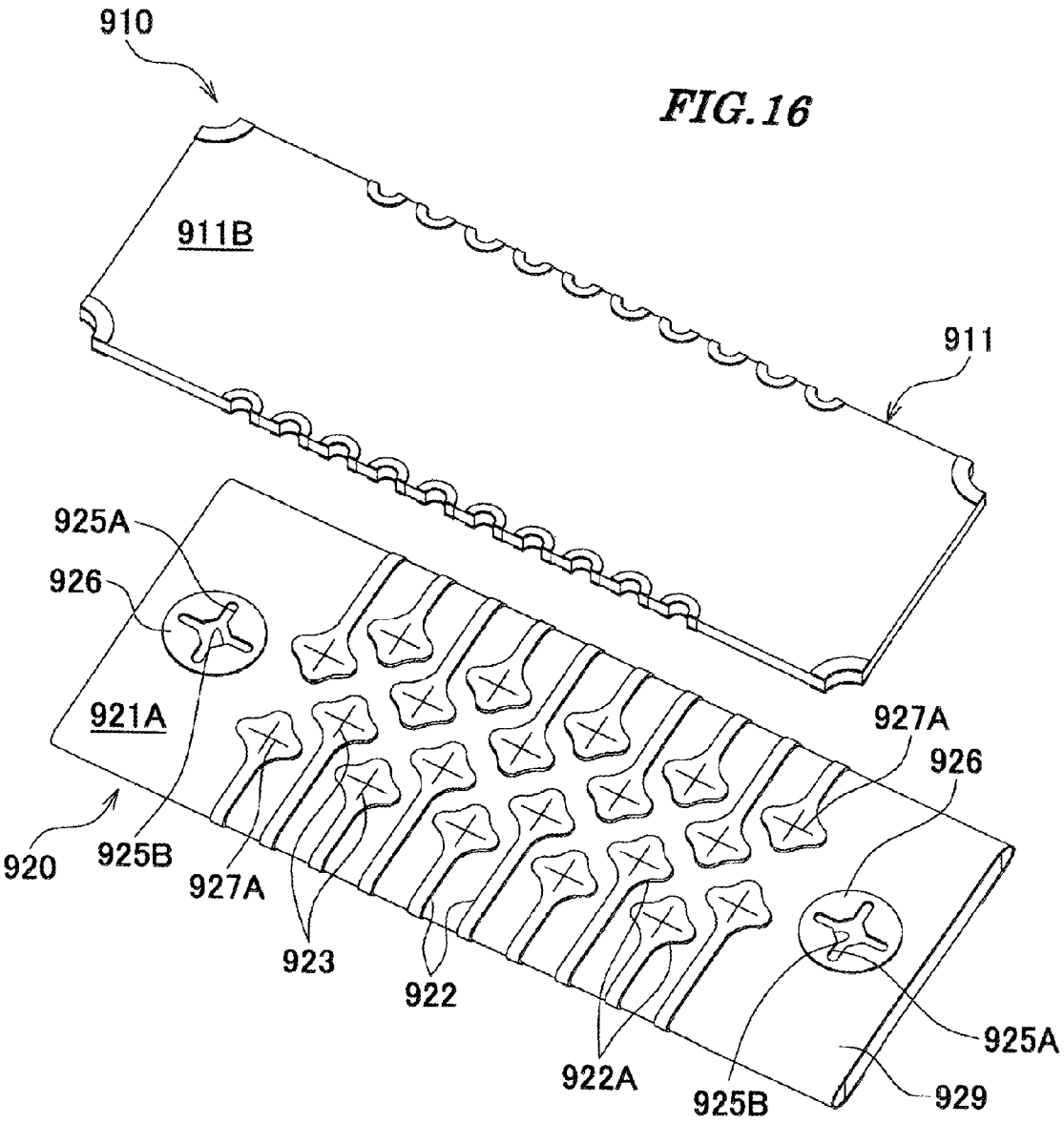
FIG. 16 is a perspective view of a conventional connector assembly, which shows a reverse side of a male connector and a front side of a female connector.
Figure 17:
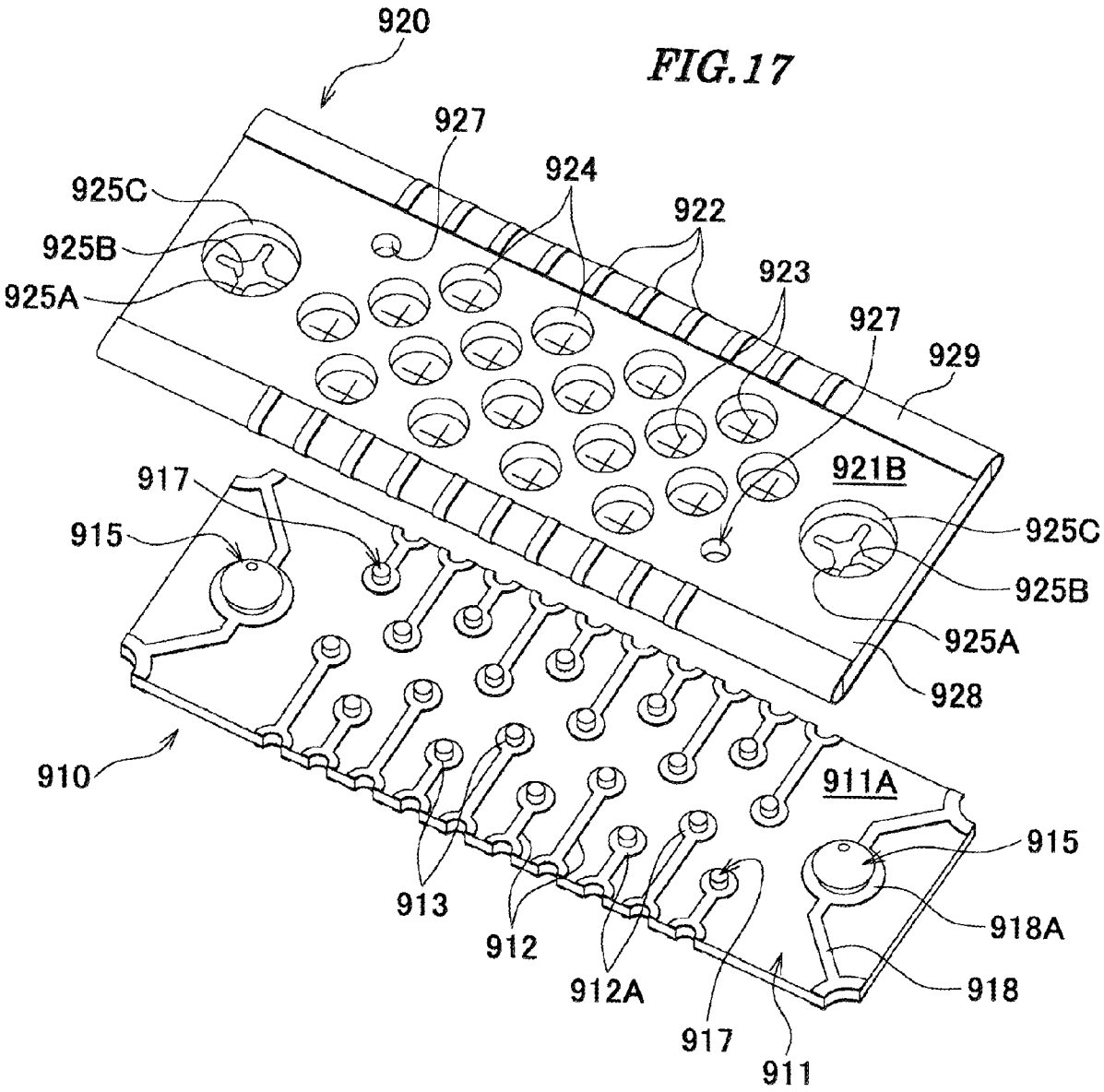
FIG. 17 is a perspective view of the connector assembly shown in FIG. 16, which shows a front side of the male connector and a reverse side of the female connector.
Figure 18:
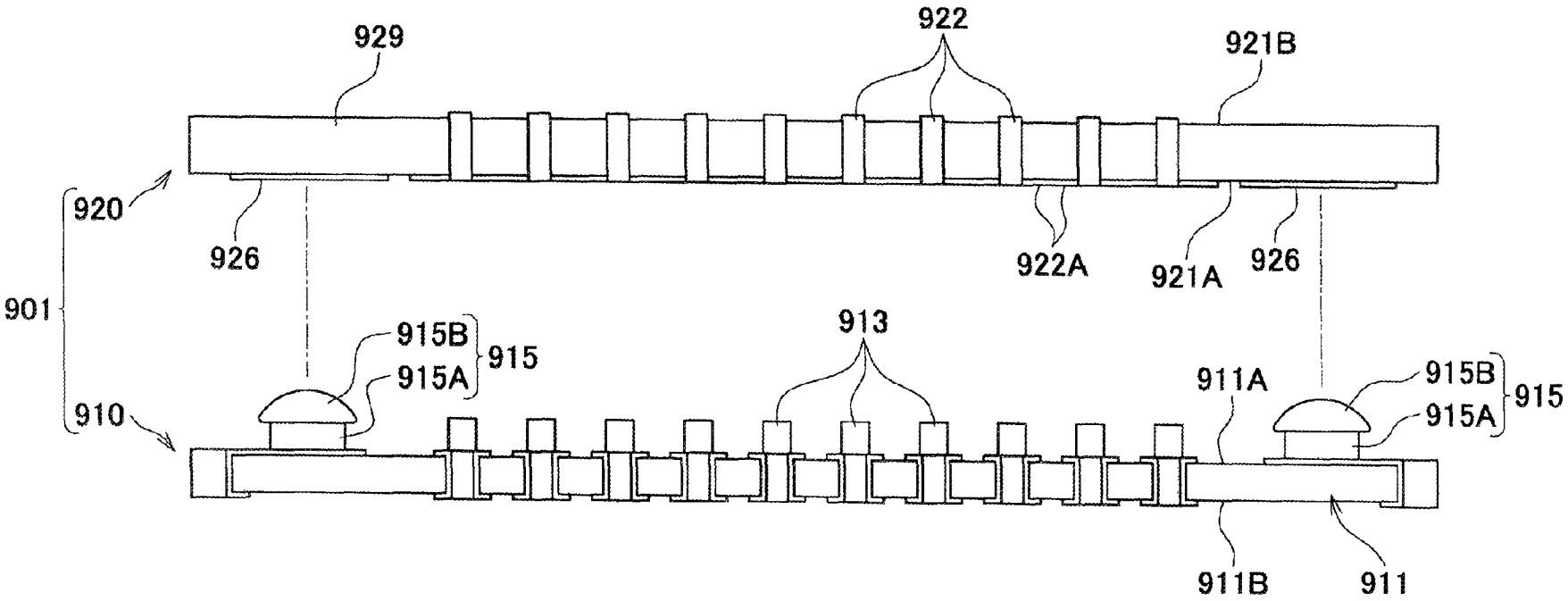
FIG. 18 is a side view of the male connector and female connector shown in FIG. 16 in a state before they are assembled to each other.

Further, when inserting the fitting portions 117 into the holes 711 of the FPC 700, respectively, it is possible to grasp the positions of the fitting portions 117 through the holes 711 of the FPC 700, and hence it is possible to position the connector 100 and the FPC 700, and thereby facilitate the connection operation. In contrast, according to the conventional technique described with reference to FIGS. 16 to 18, when connecting the male connector 910 and the female connector 920, it is difficult to position the connectors as described above, which lowers the workability.

Further, in the fitted state, the first protruding portions 117D of the first fitting portion bodies 117A are hooked on the first protruding portions 711A of the holes 711 of the FPC 700, respectively, and the second protruding portions 117E of the second fitting portion bodies 117B are hooked on the second protruding portions 711B of the holes 711 of the FPC 700, respectively, whereby connection strength between the connector 100 and the FPC 700 is increased, and hence even when a force of separating the FPC 700 from the connector 100 is generated, the FPC 700 is difficult to be removed from the connector 100.

Furthermore, when connecting the connector 100 and the FPC 700, the arm portions 118 and 119 are pushed downward via the FPC 700, whereby the first fitting portion bodies 117A and the second fitting bodies 117B are pivoted to thereby put the fitting portions 117 in the fitted state, and hence this further facilitates the operation for connecting the connector 100 and the FPC 700.

Figure 11:
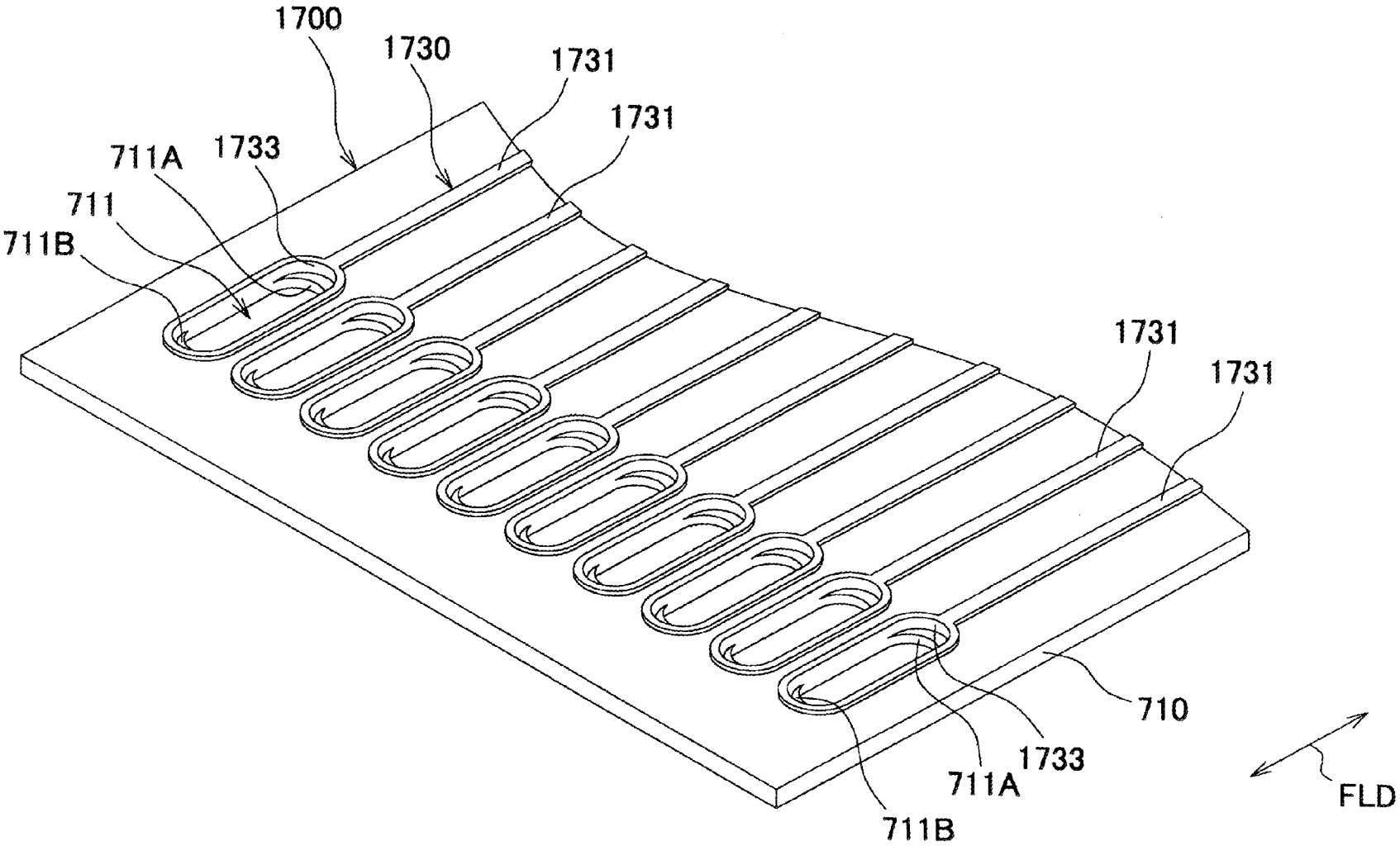
FIG. 11 is a partial perspective view of an FPC which is different from the FPC appearing in FIG. 1.
Figure 12:
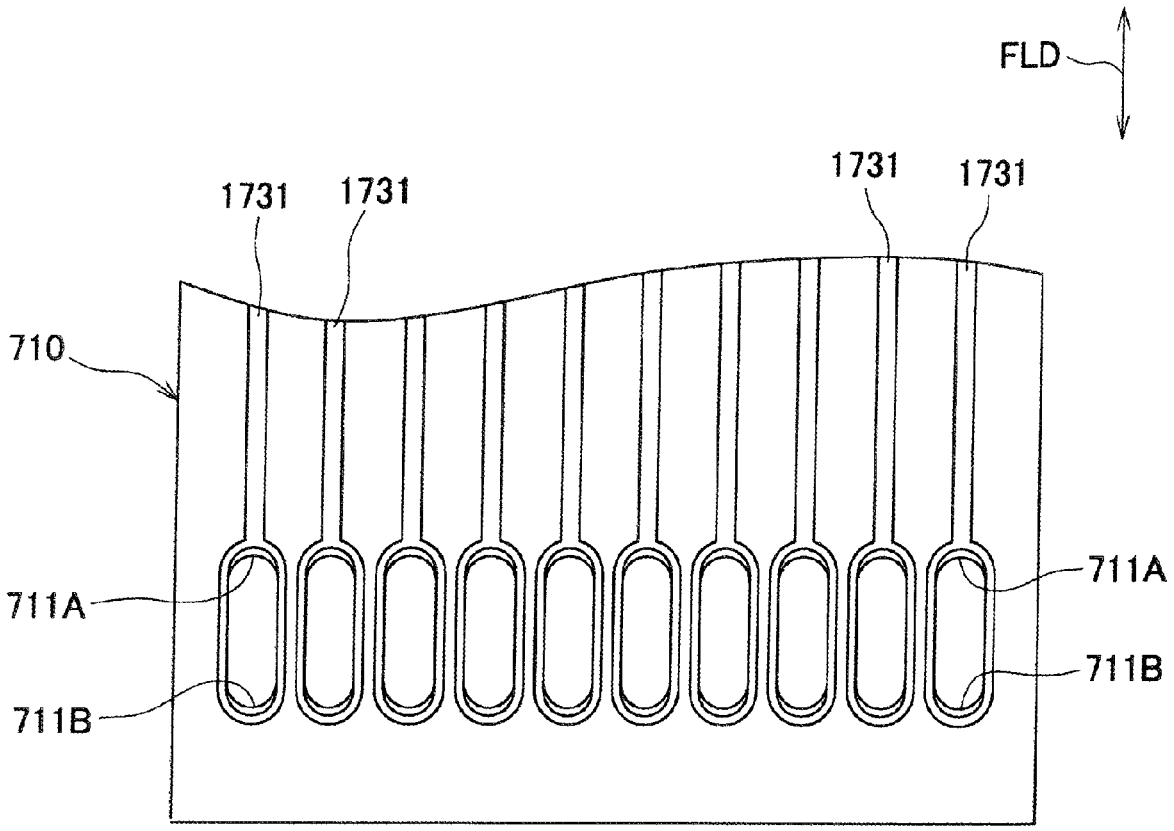
FIG. 12 is a plan view of the FPC shown in FIG. 11.

The connector 100 according to the present embodiment can also be used as a connector for an FPC 1700, shown in FIGS. 11 and 12, which is different from the FPC 700 shown in FIG. 10. A conductive path pattern 1730 of the FPC 1700 is comprised of first conductive paths 1731 and first terminal portions (terminal portions) 1733 formed on the inner surfaces of the holes 711. When the FPC 1700 is used as the first object to be connected, each first conductive path 130A including the connection portion 131, the contact portion 133, and the integral connection portion 135, or each second conductive path 130B including the connection portion 132, the contact portion 134, and the integral connection portion 136 can be omitted from the connector 100.

Figure 13:
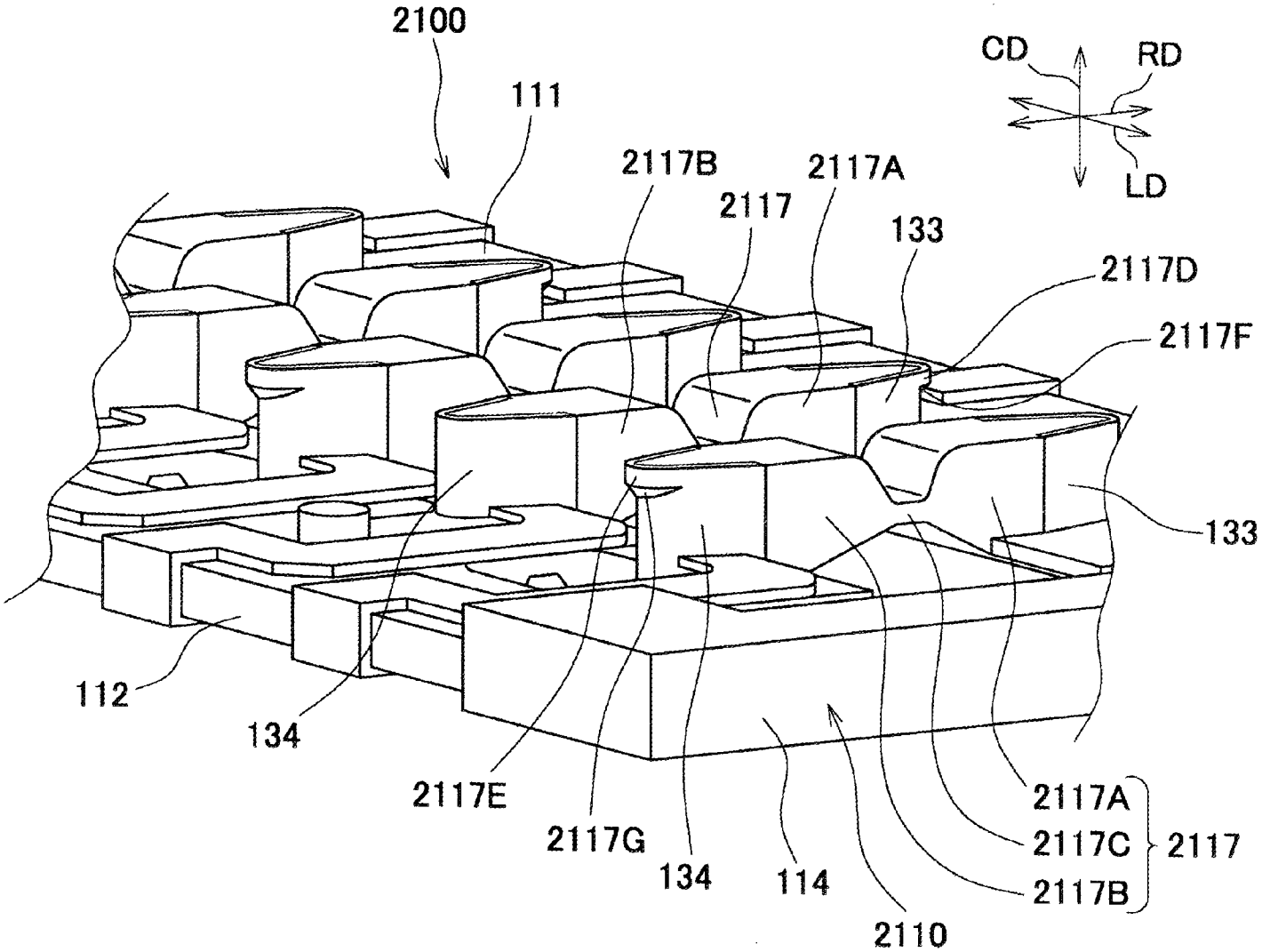
FIG. 13 is a partial enlarged perspective view of a variation of the connector appearing in FIG. 1.
Figure 14:
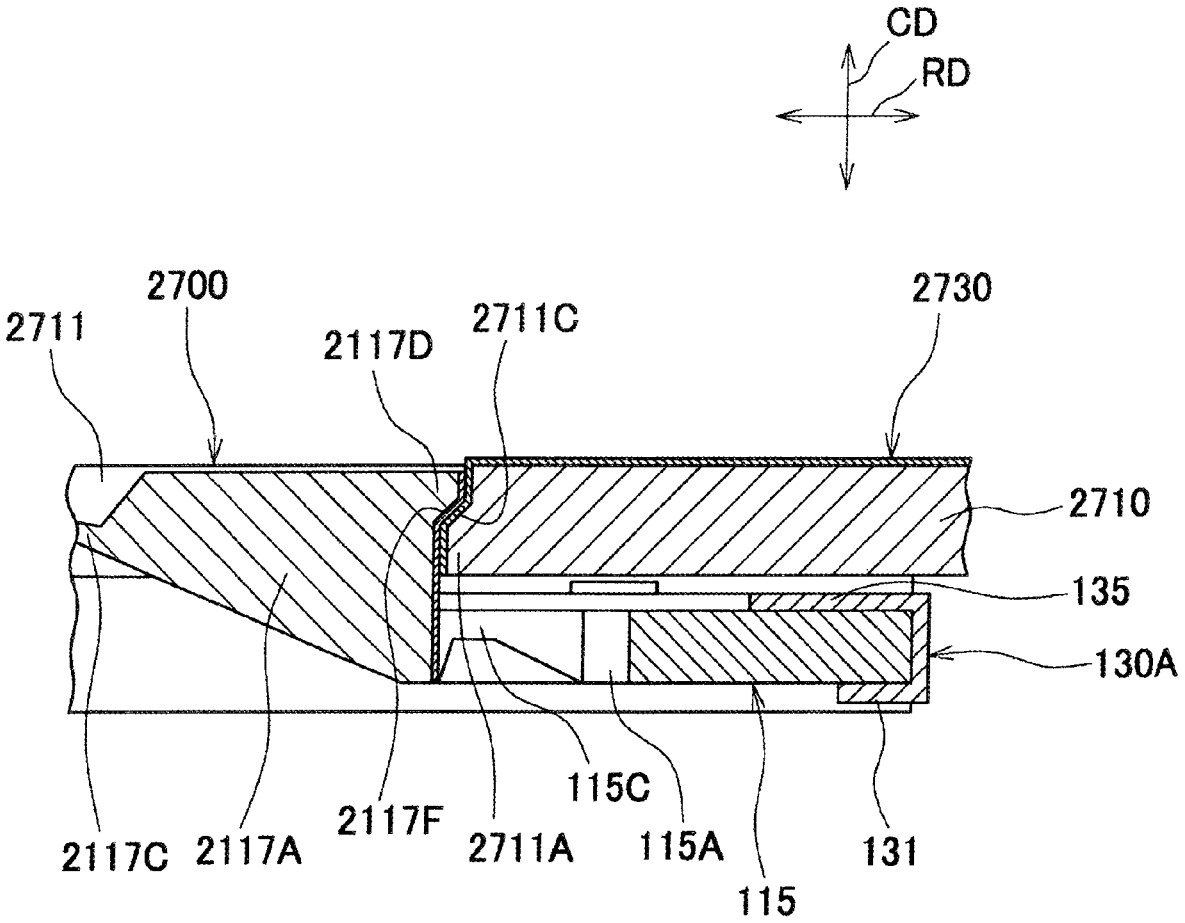
FIG. 14 is a partial cross-sectional view of the connector shown in FIG. 13.

Next, a description will be given of a variation of the above-described embodiment with reference to FIGS. 13 to 15.

The following description is given mainly of different points from the above-described embodiment.

Figure 15:
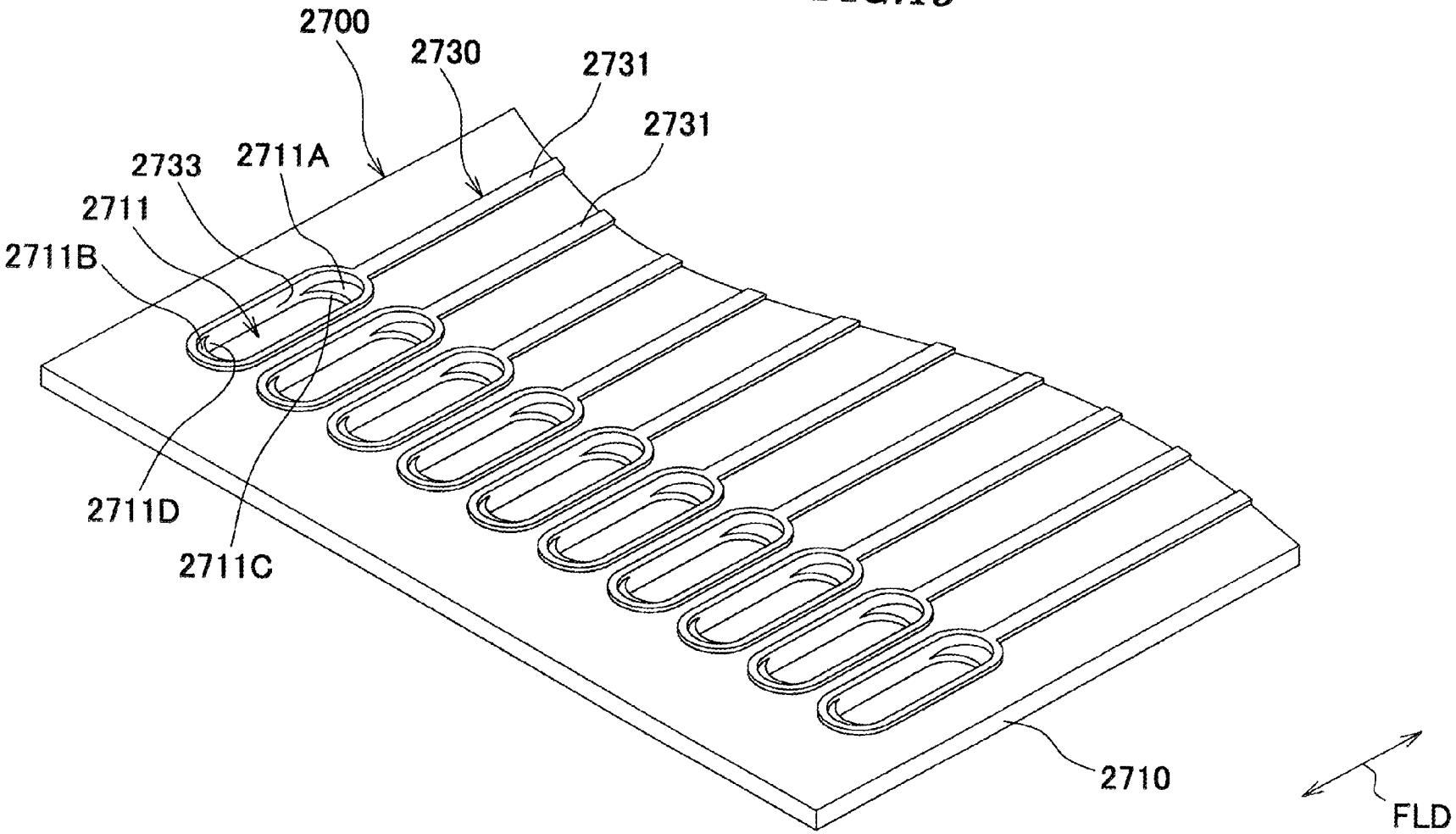
FIG. 15 is a partial perspective view of an FPC for being connected to the connector appearing in FIG. 13.

This variation is a connector compatible with an FPC 2700 shown in FIG. 15. A conductive path pattern 2730 of the FPC

2700 is comprised of first conductive paths 2731 and first terminal portions (terminal portions) 2733 formed on inner surfaces of holes 2711 of an insulating film 2710, respectively.

Lower portions of the inner surface of each hole 2711 of the insulating film 2710 of the FPC 2700 are formed with a first inclined portion 2711A and a second inclined portion 2711B, respectively. The first inclined portion 2711A and the second inclined portion 2711B are opposed to each other in a longitudinal direction FLD of the FPC 2700. The first inclined portion 2711A includes a first inclined surface (first to-be-connected object-side inclined surface) 2711C. The second inclined portion 2711B includes a second inclined surface (second to-be-connected object-side inclined surface) 2711D.

First fitting portion bodies 2117A of respective even-numbered fitting portions 2117 counted from the fitting portion 2117 closest to one end of the insulating member 2110 of a connector 2100 (the fitting portion 2117 at the right end, as viewed in FIG. 13) are each formed with a first protruding portion 2117D, and second fitting portion bodies 2117B of respective odd-numbered fitting portions 2117 counted from the fitting portion 2117 closest to the one end of the insulating member 2110 are each formed with a second protruding portion 2117E. The first protruding portion 2117D is located at an upper portion of an end of the first fitting portion body 2117A toward the first base portion 111, and the second protruding portion 2117E is located at an upper portion of an end of the second fitting portion body 2117B toward the second base portion 112. The first protruding portion 2117D includes a first inclined surface (first fitting portion-side inclined surface) 2117F. The second protruding portion 2117E includes a second inclined surface (second fitting portion-side inclined surface) 2117G.

In the fitted state, the first inclined surface 2117F is hooked on the first inclined surface 2711C, and the second inclined surface 2117G is hooked on the second inclined surface 2711D.

According to this variation, it is possible to obtain the same advantageous effects as provided by the above-described embodiment.

In the above-described embodiment, the hinge portions 115C and 116C are bendable, and the description is given such that this is not limitative, but the hinge portions 115C and 116C may be elastically deformable. However, the hinge portions 115C and 116C are not necessarily required to be elastically deformable, but it is only required that at least one of the first supporting portion 115, the second supporting portion 116, and the fitting portion 117 is elastically deformable.

Further, although in the above-described embodiment, the first fitting portion bodies 117A of the respective even-numbered fitting portions 117 counted from the fitting portion 117 closest to the one end of the insulating member 110 are each formed with the first protruding portion 117D, and the second fitting portion bodies 117B of the respective odd-numbered fitting portions 117 counted from the fitting portion 117 closest to the one end of the insulating member 110 are each formed with the second protruding portion 117E, the first protruding portion 117D may be formed on all of the first fitting portion bodies 117A, and the second protruding portion 117E may be formed on all of the second fitting portion bodies 117B.

Although in the above-described variation, the first fitting portion bodies 2117A of the respective odd-numbered fitting portions 2117 counted from the fitting portion 2117 closest to the one end of the insulating member 2110 are each formed with the first protruding portion 2117D, and the second fitting portion bodies 2117B of the respective even-numbered fitting portions 2117 counted from the fitting portion 2117 closest to the one end of the insulating member 2110 are each formed with the second protruding portion 2117E, the first protruding portion 2117D may be formed on all of the first fitting portion bodies 2117A, and the second protruding portion 2117E may be formed on all of the second fitting portion bodies 2117B.

Further, although in the above-described embodiment, one of the first fitting portion body 117A and the second fitting portion body 117B is provided with the arm portion 118 or 119, both of the first fitting portion body 117A and the second fitting portion body 117B may be provided with the arm portions 118 and 119.

It is further understood by those skilled in the art that the foregoing are the preferred embodiments of the present invention, and that various changes and modification may be made thereto without departing from the spirit and scope thereof.

What is claimed is:

1. A connector that is disposed between a first object to be connected and a second object to be connected, and connects the first object to be connected and the second object to be connected, comprising:

an insulating member including:

a first base portion, a second base portion arranged in opposed relation to said first base portion, a first supporting portion that extends from said first base portion, a second supporting portion that extends from said second base portion, and a fitting portion that is flexible and is supported by said first supporting portion and said second supporting portion, and is fitted in a hole formed in the first object to be connected; and a conductive path provided on said insulating member and including:

a connection portion that is provided on at least one of said first base portion and said second base portion, and is connected to the second object to be connected, a contact portion that is provided on said fitting portion, and is brought into contact with a terminal portion of the first object to be connected, which is provided in an inner surface of the hole, and a conductive path-side integral connection portion that integrally connects said connection portion and said contact portion, wherein said fitting portion can be switched, by flexing thereof, between a fitted state in which said fitting portion is fitted in the hole such that said contact portion is pressed against the terminal portion, and a removal enabling state in which the fitted state is released such that the first object to be connected can be removed from said fitting portion.

2. The connector according to claim 1, wherein a plurality of said first supporting portions, a plurality of said second supporting portions, and a plurality of said fitting portions are arranged in a longitudinal direction of said first base portion, respectively, wherein respective positions of said first supporting portions and respective positions of said second supporting portions match in the longitudinal direction, and wherein the respective positions of said first supporting portions and respective positions of said fitting portions are shifted from each other in the longitudinal direction.

3. The connector according to claim 1, wherein said first supporting portion includes a hinge portion which is bendable, wherein said fitting portion includes a pair of fitting portion bodies, and a fitting portion-side integral connection portion that connects said pair of said fitting portion bodies in such a manner that said pair of said fitting portion bodies are aligned in an intersecting direction intersecting with the longitudinal direction and a direction of fitting said fitting portion in the hole, wherein one fitting portion body of said pair of said fitting portion bodies is connected to front end portions of two adjacent ones of said first supporting portions in a manner sandwiched therebetween in the longitudinal direction, wherein the other fitting portion body of said pair of said fitting portion bodies is connected to front end portions of two adjacent ones of said second supporting portions in a manner sandwiched therebetween in the longitudinal direction, wherein when said fitting portion in an elongated state is flexed, a linear distance in the intersecting direction between one end and the other end of part of said fitting portion toward the first object to be connected becomes shorter than a length of the hole in the intersecting direction, whereby said contact portion is moved away from the terminal portion, and said fitting portion is put in the removal enabling state, and wherein when said fitting portion in a flexed state is elongated, the linear distance becomes longer than when said fitting portion is in the removal enabling state, whereby said fitting portion is fitted in the hole, and said contact portion is pressed against the terminal portion, to put said fitting portion in the fitted state.

4. The connector according to claim 2, wherein said first supporting portion includes a hinge portion which is bendable, wherein said fitting portion includes a pair of fitting portion bodies, and a fitting portion-side integral connection portion that connects said pair of said fitting portion bodies in such a manner that said pair of said fitting portion bodies are aligned in an intersecting direction intersecting with the longitudinal direction and a direction of fitting said fitting portion in the hole, wherein one fitting portion body of said pair of said fitting portion bodies is connected to front end portions of two adjacent ones of said first supporting portions in a manner sandwiched therebetween in the longitudinal direction, wherein the other fitting portion body of said pair of said fitting portion bodies is connected to front end portions of two adjacent ones of said second supporting portions in a manner sandwiched therebetween in the longitudinal direction, wherein when said fitting portion in an elongated state is flexed, a linear distance in the intersecting direction between one end and the other end of part of said fitting portion toward the first object to be connected becomes shorter than a length of the hole in the intersecting direction, whereby said contact portion is moved away from the terminal portion, and said fitting portion is put in the removal enabling state, and wherein when said fitting portion in a flexed state is elongated, the linear distance becomes longer than when said fitting portion is in the removal enabling state, whereby said fitting portion is fitted in the hole, and said contact portion is pressed against the terminal portion, to put said fitting portion in the fitted state.

5. The connector according to claim 3, wherein when said fitting portion is in the removal enabling state, said fitting portion-side integral connection portion is at a location closer in the fitting direction to the second object to be connected than said hinge portion is, and when said fitting portion is in the fitted state, said fitting portion-side integral connection portion is at a location closer in the fitting direction to the first object to be connected than said hinge portion is.

6. The connector according to claim 4, wherein when said fitting portion is in the removal enabling state, said fitting portion-side integral connection portion is at a location closer in the fitting direction to the second object to be connected than said hinge portion is, and when said fitting portion is in the fitted state, said fitting portion-side integral connection portion is at a location closer in the fitting direction to the first object to be connected than said hinge portion is.

7. The connector according to claim 3, wherein said fitting portion includes a fitting portion-side protruding portion that is provided on one of an end of one of said pair of said fitting portion bodies, toward said first base portion, and an end of the other of said pair of said fitting portion bodies, toward said second base portion, and is hooked on a to-be-connected object-side protruding portion provided on the inner surface of the hole when in the fitted state.

8. The connector according to claim 4, wherein said fitting portion includes a fitting portion-side protruding portion that is provided on one of an end of one of said pair of said fitting portion bodies, toward said first base portion, and an end of the other of said pair of said fitting portion bodies, toward said second base portion, and is hooked on a to-be-connected object-side protruding portion provided on the inner surface of the hole when in the fitted state.

9. The connector according to claim 3, wherein said fitting portion includes a fitting portion-side protruding portion that is provided on both of an end of one of said pair of said fitting portion bodies, toward said first base portion, and an end of the other of said pair of said fitting portion bodies, toward said second base portion, and is hooked on a to-be-connected object-side protruding portion provided on the inner surface of the hole when in the fitted state.

10. The connector according to claim 4, wherein said fitting portion includes a fitting portion-side protruding portion that is provided on both of an end of one of said pair of said fitting portion bodies, toward said first base portion, and an end of the other of said pair of said fitting portion bodies, toward said second base portion, and is hooked on a to-be-connected object-side protruding portion provided on the inner surface of the hole when in the fitted state.

11. The connector according to claim 3, wherein said fitting portion includes a first fitting portion-side inclined surface that is provided on an end of one of said pair of said fitting portion bodies, toward said first base portion, and is brought into contact with a first to-be-connected object-side inclined surface that is provided on the inner surface of the hole in the fitted state.

12. The connector according to claim 4, wherein said fitting portion includes a first fitting portion-side inclined surface that is provided on an end of one of said pair of said fitting portion bodies, toward said first base portion, and is brought into contact with a first to-be-connected object-side inclined surface that is provided on the inner surface of the hole in the fitted state.

13. The connector according to claim 3, wherein said fitting portion includes:

a first fitting portion-side inclined surface that is provided on an end of one of said pair of said fitting portion bodies, toward said first base portion, and is brought into contact with a first to-be-connected object-side inclined surface that is provided on the inner surface of the hole, when in the fitted state; and a second fitting portion-side inclined surface that is provided on an end of the other of said pair of said fitting portion bodies, toward said second base portion, and is brought into contact with a second to-be-connected object-side inclined surface that is provided on the inner surface of the hole, when in the fitted state.

14. The connector according to claim 4, wherein said fitting portion includes:

a first fitting portion-side inclined surface that is provided on an end of one of said pair of said fitting portion bodies, toward said first base portion, and is brought into contact with a first to-be-connected object-side inclined surface that is provided on the inner surface of the hole, when in the fitted state; and a second fitting portion-side inclined surface that is provided on an end of the other of said pair of said fitting portion bodies, toward said second base portion, and is brought into contact with a second to-be-connected object-side inclined surface that is provided on the inner surface of the hole, when in the fitted state.

15. The connector according to claim 3, wherein said insulating member includes an arm portion that extends from at least one of said pair of said fitting portion bodies toward said first base portion or said second base portion, and is pressed by the first object to be connected when said fitting portion and the hole are fitted, to thereby elongate said fitting portion.

16. The connector according to claim 4, wherein said insulating member includes an arm portion that extends from at least one of said pair of said fitting portion bodies toward said first base portion or said second base portion, and is pressed by the first object to be connected when said fitting portion and the hole are fitted, to thereby elongate said fitting portion.

17. The connector according to claim 15, wherein when said fitting portion is in the removal enabling state, a free end portion of said arm portion is at a location closer in the fitting direction to the first object to be connected than said first base portion or said second base portion is, and wherein when said fitting portion is in the fitted state, said free end portion of said arm portion is received between said two adjacent ones of said first supporting portions or between said two adjacent ones of said second supporting portions.

18. The connector according to claim 16, wherein when said fitting portion is in the removal enabling state, a free end portion of said arm portion is at a location closer in the fitting direction to the first object to be connected than said first base portion or said second base portion is, and wherein when said fitting portion is in the fitted state, said free end portion of said arm portion is received between said two adjacent ones of said first supporting portions or between said two adjacent ones of said second supporting portions.

19. The connector according to claim 3, wherein said plurality of said first supporting portions are integrally connected via one of said pair of said fitting portion bodies, and said plurality of second supporting portions are integrally connected via the other of said pair of said fitting portion bodies.

20. The connector according to claim 4, wherein said plurality of said first supporting portions are integrally connected via one of said pair of said fitting portion bodies, and said plurality of second supporting portions are integrally connected via the other of said pair of said fitting portion bodies.

* * * * *